US008141994B2

(12) United States Patent
Ito et al.

(10) Patent No.: US 8,141,994 B2
(45) Date of Patent: Mar. 27, 2012

(54) INK CARTRIDGE AND INKJET RECORDING SYSTEM

(75) Inventors: Noritsugu Ito, Tokoname (JP); Shingo Ito, Kasugai (JP); Wataru Sugiyama, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 488 days.

(21) Appl. No.: 12/397,322

(22) Filed: Mar. 3, 2009

(65) Prior Publication Data

US 2009/0167828 A1 Jul. 2, 2009

Related U.S. Application Data

(63) Continuation-in-part of application No. PCT/JP2007/069084, filed on Sep. 28, 2007.

(30) Foreign Application Priority Data

Sep. 29, 2006 (JP) ..... 2006-266899

(51) Int. Cl.
*B41J 2/175* (2006.01)

(52) U.S. Cl. ..... 347/85

(58) Field of Classification Search ..... 347/85–86
See application file for complete search history.

(56) References Cited

U.S. PATENT DOCUMENTS 7,562,972 B2 * 7/2009 Hattori et al. ..... 347/86

FOREIGN PATENT DOCUMENTS

| | | | |
|---|---|---|---|
| JP | H05-008383 | A | 1/1993 |
| JP | H06-115089 | A | 4/1994 |
| JP | 2000-326519 | A | 11/2000 |
| JP | 2005-125738 | A | 5/2005 |
| JP | 2005-246781 | A | 9/2005 |
| JP | 2005-254734 | A | 9/2005 |
| JP | 2005-262564 | A | 9/2005 |

OTHER PUBLICATIONS

International Bureau; Notification of Transmittal of Translation of the International Preliminary Report on Patentability in International Application No. PCT/JP2007/069084, mailed Apr. 30, 2009.

European Patent Office, Extended European Search Report for European Patent Application No. 07828825.5, dated Oct. 20, 2010.

* cited by examiner

*Primary Examiner* — Matthew Luu
*Assistant Examiner* — Lisa M Solomon
(74) *Attorney, Agent, or Firm* — Baker Botts L.L.P.

(57) ABSTRACT

An ink cartridge includes a cartridge main body, an ink-outputting section, and at least two first light-shielding parts. The cartridge main body has an ink accommodating chamber accommodating ink therein. The ink-outputting section that outputs the ink in the ink accommodating chamber. The at least two first light-shielding parts are juxtaposed in the prescribed mounting direction at a prescribed interval and that are incapable of moving relative to the cartridge main body. Lengths in the prescribed mounting direction of the at least two first light-shielding parts are different from one another.

11 Claims, 26 Drawing Sheets

INK CARTRIDGE AND INKJET RECORDING SYSTEM

The present application is a Continuation-in-Part of International Application No. PCT/JP2007/069084 filed on Sep. 28, 2007, which claims the benefits of Japanese Patent Application No. 2006-266899 filed on Sep. 29, 2006; the disclosures of which are incorporated herein by reference.

TECHNICAL FIELD

The invention relates to an ink cartridge storing ink and an inkjet recording system comprising ink cartridges and an inkjet recording device.

BACKGROUND ART

One type of inkjet recording device well known in the art has ink cartridges immovably mounted in the body of the device. Unlike printers having ink cartridges mounted in a carriage, the ink cartridges in a printer having this construction do not move during printing operations, preventing the introduction of air bubbles in the ink and other related problems.

This type of inkjet recording device is commonly provided with cartridge-detecting means for detecting when ink cartridges are mounted. Common types of cartridge-detecting means include optical detecting means such as a transmission-type photosensor having a light-emitting element and a light-receiving element, and electrical detecting means such as an electrical contact switch that detects an ink cartridge through contact with a terminal provided on the ink cartridge. However, since contact problems frequently occur with electrical detecting means such as the electrical contact switches due to ink becoming deposited on the contacts, it is preferable to use photosensors or other optical detecting means to avoid such problems.

Patent Reference 1 discloses an inkjet recording device using transmission-type photosensors to detect when ink cartridges are mounted. The inkjet recording device described in Patent Reference 1 includes cartridge-mounting units (holders) and photosensors disposed one on each holder and provided with a light-emitting element and a light-receiving element at positions opposing each other. Each ink cartridge has a cartridge body storing ink therein. A light-shielding (non-translucent) protruding part extending vertically (in the direction that the ink cartridge is mounted and that ink flows out of the ink cartridge) is formed on a side wall portion of the cartridge body. When an ink cartridge is mounted in a holder, the protruding part on the side wall portion passes between the light-emitting element and the light-receiving element of the photosensor, momentarily blocking light emitted from the light-emitting element, which enables the photosensor to detect mounting of the ink cartridge. When mounting of the ink cartridge is completed, the protruding part is not positioned between the light-emitting element and the light-receiving element in Patent Reference 1 so that the photosensor can additionally detect the presence of ink in the mounted ink cartridge (residual ink detection) when not detecting mounting of the ink cartridge.

Specifically, a light-shielding plate for residual ink detection is provided inside the cartridge in Patent Reference 1. The light-shielding plate is coupled to a hollow float via a pivoting arm so as to pivot along with fluctuations in the residual ink. If sufficient ink remains in the cartridge body, the light-shielding plate and the protruding part for detecting the mount of the cartridge are aligned vertically (in the direction that the ink cartridge is mounted). Accordingly, if an ink cartridge having a sufficient amount of residual ink is mounted in the holder, the protruding part blocks light emitted from the light-emitting element of the photosensor while passing between the light-emitting element and light-receiving element. When mounting is completed, the light-shielding plate is positioned between the light-emitting element and the light-receiving element and, thus, blocks light emitted from the light-emitting element. In other words, a single photosensor can be used both for detecting the ink cartridge and for detecting residual ink.

Thus, Patent Reference 1 employs a construction in which the protruding part for detecting mounting of the cartridge interrupts light emitted from the light-emitting element only when passing between the light-emitting element and light-receiving element during mounting and removal of the cartridge and does not remain positioned between the light-emitting element and light-receiving element after mounting is completed. This configuration intends to provide the photosensor used to detect mounting of the ink cartridge with a separate function (i.e., residual ink detection). However, in light of other design considerations, there is potential for the photosensor to be employed for yet other intentions. Patent Reference 1: Japanese patent application publication No. 2005-254734

SUMMARY

Since most inkjet recording devices are provided with a display unit for displaying messages and the like for the user, it is preferable to display, on this display unit, information indicating whether the photosensor detected an ink cartridge. In other words, while the user can certainly discern whether an ink cartridge is present in the cartridge-mounting unit by visually checking the cartridge-mounting unit, it is more user-friendly to display data on the display unit indicating the presence of the ink cartridge since users unconsciously tend to check the display unit first.

However, it is not always easy for the control unit to accurately detect whether the ink cartridge is actually mounted by only the portion of the detection (the protruding part in Patent Reference 1) that passes between the light-emitting element and the light-receiving element only when the ink cartridge is mounted or removed and does not remain between the light-emitting element and the light-receiving element once mounting is completed.

Here, it would be possible to store data indicating the presence of ink cartridges in a suitable storing means and to update the stored data each time output from the photosensor changes, i.e., when the object of detection on the ink cartridge interrupts light emitted from the light-emitting element as the ink cartridge is mounted or removed. However, there is a danger that mounting or removal of an ink cartridge may be incorrectly detected based on changes in output from the photosensor if an object other than the ink cartridge passes between the light-emitting element and the light-receiving element of the photosensor.

Since the photosensor in Patent Reference 1 described above is capable of detecting the presence of ink in the ink cartridge when the cartridge is in a mounted state, it is certainly possible to detect whether the ink cartridge is mounted by detecting the presence of ink with the photosensor immediately after the protruding part passes between the light-emitting element and the light-receiving element of the photosensor. That is, it can be determined that an ink cartridge is mounted when the light-shielding plate for detecting residual ink blocks light emitted from the light-emitting element immediately after a change occurs in output from the photosensor due to the protruding part momentarily interrupting light emitted from the light-emitting element. Further, removal of the ink cartridge can be determined when light emitted from the light-emitting element is not blocked after the protruding part momentarily blocks the emitted light.

However, this method of detection is only effective when the mounted ink cartridge has residual ink. A control unit of the printer cannot correctly recognize an ink cartridge if the user mistakenly mounts an empty cartridge. In other words, if an empty cartridge is mounted, the light-shielding plate will not block light emitted from the light-emitting element immediately after a change occurs in output from the photosensor due to the protruding part temporarily interrupting emitted light. Since the waveform outputted from the photosensor in this case is identical to that outputted when the ink cartridge is removed from its holder, the control unit cannot distinguish between the two cases. As a result, reliable data regarding the presence of ink cartridges cannot be displayed on the display unit.

It is an object of the invention to provide an ink cartridge having a light-shielding part that blocks light emitted from optical detecting means provided in an inkjet recording device, wherein the optical detecting means detects when the ink cartridge is mounted, and being capable of enabling a control unit in the inkjet recording device to correctly recognize the presence of the ink cartridge.

In order to attain the above and other objects, the invention provides an ink cartridge mountable on a cartridge mounting section of an inkjet recording system through insertion of the ink cartridge in a prescribed mounting direction. The inkjet recording system includes an optical detecting unit. The ink cartridge includes a cartridge main body, an ink-outputting section, and at least two first light-shielding parts. The cartridge main body has an ink accommodating chamber accommodating ink therein. The ink-outputting section outputs the ink in the ink accommodating chamber. The at least two first light-shielding parts are juxtaposed in the prescribed mounting direction at a prescribed interval and are incapable of moving relative to the cartridge main body. The at least two first light-shielding parts is used in conjunction with the optical detecting unit for detecting mounting and dismounting of the ink cartridge. Lengths in the prescribed mounting direction of the at least two first light-shielding parts are different from one another.

According to the configuration described above, the lengths in the prescribed mounting direction of the at least two first light-shielding parts are different from one another. Lengths of times in which the at least two first light-shielding parts blocks light from the light emitting parts when the at least two first light-shielding parts pass between the light emitting part and the light receiving part of the optical detecting unit provided in the inkjet recording device, are different from one another. Further, the at least two first light-shielding parts blocks light in order of the front end side and the rear end side in the mounting direction when mounting the ink cartridge. On the other hand, the at least two first light-shielding parts blocks light in order of the rear end side and the front end side in the mounting direction when removing the ink cartridge. Therefore, at least two waveforms (or relation of the waveforms with respect to length) outputted from the cartridge detecting unit when the at least two light-shielding parts block light emitted from the light emitting part, are different between when mounting the ink cartridge and when removing the ink cartridge. Thus, the mounting operation and the removing operation can be detected distinguishingly. Accordingly, the control unit of the inkjet recording device correctly determines whether the ink cartridge is mounted or not. The control unit can display correct information about the presence of the ink cartridge on the display unit.

It is preferable that the ink cartridge further includes a second light-shielding part that is used in conjunction with the optical detecting unit for detecting an amount of ink accommodated in the ink accommodating chamber. The second light-shielding part is capable of moving toward a position adjacent to the at least two first light-shielding parts in the prescribed mounting direction.

In the configuration, when the second light-shielding part is adjacent to the at least two first light-shielding parts in the prescribed mounting direction, light emitted from the light emitting part is blocked by the at least two light-shielding parts instantaneously. Further, light emitted from the light emitting part is blocked by the second light-shielding part after the mounting operation is completed. Accordingly, the single cartridge detecting unit can detects the mounting and removing operation of the ink cartridge and the existence (or residual ink) in the ink cartridge.

It is preferable that the ink cartridge further includes a float part that is connected to the second light-shielding part, that has a specific gravity lower than a specific gravity of the ink in the ink accommodating chamber, and that moves to follow the fluctuations of an ink level accommodated in the ink accommodating chamber. The motion of the float part by the fluctuations of the ink level prompts the second light-shielding part to move to the position adjacent to the at least two first light-shielding parts.

According to this configuration, the float part moves following the fluctuation of the ink level. The second light-shielding part moves between a position adjacent to the at least two first light-shielding parts and a position that is not adjacent to the at least two first light-shielding parts, following the motion of the float part. Thus, it is detected that the ink exists in the ink cartridge by determining whether light emitted from the light emitting parts in the cartridge detecting unit provided in the cartridge mounting section is blocked by the second light-shielding part.

It is preferable that the ink cartridge further includes a pivoting arm that is pivotably supported in the cartridge main body. The second light-shielding part is attached to one end of the pivoting arm and the float part is attached to another end of the pivoting arm. The motion of the float part by the fluctuations of the ink level prompts the pivoting arm to pivot and the second light-shielding part to move to the position adjacent to the at least two first light-shielding parts.

In this configuration, the pivoting arm pivots when the float part provided on one end of the pivoting arm moves following the fluctuation of the ink level. Thus, the second light-shielding part provided on another end of the pivoting arm moves between a position adjacent to the at least two first light-shielding parts and a position that is not adjacent to the at least two first light-shielding parts. Accordingly, it is detected that the ink cartridge exists, by determining whether the second light-shielding part blocks light emitted from the light emitting part of the cartridge detecting part provided on the cartridge detecting unit.

It is preferable that when the float part moves following the fluctuation of the ink level in the ink accommodating chamber, the second light-shielding part moves in a direction parallel to a direction in which the float part moves.

According to this configuration, when the float part moves following the fluctuation of the ink level, the second light-shielding part moves parallel to the float part between a position adjacent to the at least two first light-shielding parts and a position that is not adjacent to the at least two first light-shielding parts. Thus, it is detected that the ink cartridge exists, by determining whether the second light-shielding part blocks light emitted from the light emitting part of the cartridge detecting part provided on the cartridge detecting unit.

It is preferable that the ink-outputting section has an ink-outputting channel fluidly communicated with the ink accommodating chamber, and an opening/closing mechanism that opens and closes the ink-outputting channel. And, the opening/closing mechanism includes a valve and an urging member. The valve is movable between a close position and an open position. The valve closes the ink-outputting channel at the close position and opens the ink-outputting channel at the open position. The urging member urges the valve toward the close position.

According to the configuration, the valve is urged toward the close position closing the ink-outputting section by the urging member. Thus, the valve prevents ink from leaking from the ink-outputting section when the ink cartridge is not mounted in the cartridge mounting section.

Ii is preferable that the cartridge mounting section includes an ink extraction tube that pushes the valve toward the open position and fluidly communicates with the ink-outputting channel when the ink cartridge is mounted on the cartridge mounting section. The ink-outputting section includes a joint part to which the ink extraction tube is inserted. The at least two first-light shielding parts include a frontmost light-shielding part and a rearmost light-shielding part. The frontmost light-shielding part is closest to the cartridge mounting section. The rearmost light-shielding part is farthest to the cartridge mounting section when the ink cartridge is placed for insertion in the cartridge mounting section. A length in the prescribed mounting direction from a front end of the frontmost light-shielding part to a rear end of the rearmost light-shielding part is less than or equal to a connection stroke from a start point for insertion of the ink extraction tube into the joint part to a point where the ink extraction tube moves the valve to the open position.

When the ink cartridge is mounted, the ink extraction tube of the cartridge mounting section is inserted into the joint part of the ink-outputting section. Further, the ink extraction tube moves the valve from the close position to the open position against the urging force of the urging member. Thus, the ink-outputting channel is open and the ink extraction tube fluidly communicates with the ink-outputting channel. Ink accommodated in the cartridge main body is supplied to the inkjet recording device via the ink-outputting channel and the ink extraction tube. At the connection stroke from a start point for insertion of the ink extraction tube into the joint part to a point where the ink extraction tube moves the valve to the open position, frictional force is generated between the ink extraction tube and the joint part. Thus, if the user varies operational forces in the operation, the moving velocity of the ink cartridge does not change rapidly, that is the moving velocity is stable.

In the invention, the length in the prescribed mounting direction from a front end of the frontmost light-shielding part to a rear end of the rearmost light-shielding part is less than or equal to a connection stroke from a start point for insertion of the ink extraction tube into the joint part to a point where the ink extraction tube moves the valve to the open position. The at least two light-shielding parts blocks light emitted from the light emitting part while the ink extraction tube moves in the ink-outputting section by the connection stroke, that is, a period when the moving velocity of the ink cartridge is stable. Accordingly, it is prevented to wrongly detect the mounting operation and the removing operation.

It is preferable that the cartridge mounting section includes a locking mechanism that holds the mounted ink cartridge in a locked state. The joint part separates from the ink extraction tube by an urging force of the urging member of the opening/closing mechanism when the ink cartridge locked by the locking mechanism is released. A length of the frontmost light-shielding part in the prescribed mounting direction is longer than a length of the rearmost light-shielding part in the prescribed mounting direction.

The joint part pops out from the cartridge mounting section (separates from the ink extraction tube) by an urging force generated by the urging member of the opening/closing mechanism when the ink cartridge locked by the locking mechanism is released. The velocity of the ink cartridge becomes high by the large urging force immediately after the ink cartridge locked by the locking mechanism is released. Subsequently, the velocity of the ink cartridge abruptly is reduced as the urging force reduces. If great changes in the velocity of the cartridge occurs, it is assumed that the relation between the lengths of the at least first light-shielding part does not directly corresponds to the relation between the lengths of the waveforms outputted from the cartridge detecting unit. Thus, it is assumed that the mounting operation and the removing operation is wrongly detected.

However, in the invention, the length of the frontmost light-shielding part is longer than the length of the rearmost light-shielding part. In the removing operation of the ink cartridge, the rearmost light-shielding part blocks light in a period when the velocity is high. The frontmost light-shielding part blocks light in a period when the velocity is reduced. Thus, the cartridge detecting unit outputs the waveforms in order of the short waveform and the long waveform. On the other hand, in the mounting operation of the cartridge, the moving velocity of the cartridge is relatively stable, that is, the great changes in the velocity do not occur. The waveforms appears in order of the long waveform and the short waveform corresponding to the lengths of the at least two light-shielding part. Similarly to the mounting operation of the ink cartridge, the relation between the lengths of the at least two waveforms is maintained. Thus, the wrong detection is prevented.

It is preferable that the urging member comprises a spring.

According to another aspects, the invention provides an ink cartridge mountable on a cartridge mounting section of an inkjet recording system through insertion of the ink cartridge in a prescribed mounting direction, the inkjet recording system including an optical detecting unit. The ink cartridge includes a cartridge main body, an ink-outputting section, and at least two first light-shielding parts. The cartridge main body has an ink accommodating chamber accommodating ink therein. The ink-outputting section outputs the ink in the ink accommodating chamber. The at least two first light-shielding parts are juxtaposed in an outputting direction to which the ink-outputting unit outputs the ink at a prescribed interval and that are incapable of moving relative to the cartridge main body. The at least two first light-shielding parts is used in conjunction with the optical detecting unit for detecting mounting and dismounting of the ink cartridge. Lengths in the outputting direction of the at least two first light-shielding parts are different from one another.

According to the configuration described above, the lengths in the outputting direction of the at least two first light-shielding parts are different from one another. Lengths of times in which the at least two first light-shielding parts blocks light from the light emitting parts when the at least two first light-shielding parts pass between the light emitting part and the light receiving part of the optical detecting unit provided in the inkjet recording device, are different from one another. Therefore, at least two waveforms (or relation of the waveforms with respect to length) outputted from the cartridge detecting unit when the at least two light-shielding parts block light emitted from the light emitting part, are different between when mounting the ink cartridge and when removing the ink cartridge. Thus, the mounting operation and the removing operation can be detected distinguishingly.

According to still another aspects, the invention provides an inkjet recording system. The inkjet recording system includes an inkjet recording device and an ink cartridge. The inkjet recording device has an inkjet head ejecting ink. The ink cartridge is mounted in a cartridge mounting section of the inkjet recording device through insertion of the ink cartridge in a prescribed mounting direction. The inkjet recording device includes an optical detecting unit that has a light emitting part and a light receiving part receiving light from the light emitting part. The ink cartridge includes a cartridge main body, an ink-outputting section, and at least two first light-shielding parts. The cartridge main body has an ink accommodating chamber accommodating ink therein. The ink-outputting section outputs the ink in the ink accommodating chamber. The at least two first light-shielding parts are juxtaposed in the prescribed mounting direction at a prescribed interval and that are incapable of moving relative to the cartridge main body. The at least two first light-shielding parts is used in conjunction with the optical detecting unit for detecting mounting and dismounting of the ink cartridge. Lengths in the prescribed mounting direction of the at least two first light-shielding parts are different from one another.

According to the configuration described above, at least two waveforms (or relation of the waveforms with respect to length) outputted from the cartridge detecting unit when the at least two light-shielding parts block light emitted from the light emitting part, are different between when mounting the ink cartridge and when removing the ink cartridge. Thus, the mounting operation and the removing operation can be detected distinguishingly. Accordingly, the inkjet recording system correctly determines whether the ink cartridge is mounted or not. The inkjet recording system can display correct information about the presence of the ink cartridge on the display unit.

EFFECTS OF THE INVENTION

According to the invention, waveforms outputted from the cartridge detecting unit when the at least two light-shielding parts block light emitted from the light emitting part, are different between when mounting the ink cartridge and when removing the ink cartridge. Thus, the mounting operation and the removing operation can be detected distinguishingly. Accordingly, the control unit of the inkjet recording device correctly determines whether the ink cartridge is mounted or not. The control unit can display correct information about the presence of the ink cartridge on the display unit.

BRIEF DESCRIPTION OF THE DRAWINGS

FIG. 9(*b*) is an explanatory diagram showing the operation of the ink cartridge and the cartridge mounting unit in mid-course of the installation;

FIG. 9(*c*) is an explanatory diagram showing the operation of the ink cartridge and the cartridge mounting unit when the installation is finished;

FIG. 11(*b*) shows waveforms outputted from the photosensor under a condition shown in FIG. 11(*a*);

FIG. 12(*b*) shows waveforms outputted from the photosensor under a condition shown in FIG. 12(*a*);

FIG. 13(*b*) shows waveforms outputted from the photosensor under a condition shown in FIG. 13(*a*);

FIG. 14(*b*) shows waveforms outputted from the photosensor under a condition shown in FIG. 14(*a*);

FIG. 16(*b*) shows waveforms outputted from the photosensor when the cartridge is mounted abnormally;

FIG. 28(*b*) shows waveforms from the photosensor when the sensor malfunctions.

DETAILED DESCRIPTION

An embodiment of the invention will be described while referring to the accompanying drawings. First, a brief description of an inkjet recording system will be given. The inkjet recording system includes ink cartridges, and an inkjet printer that records desired text, images, and the like on recording paper using ink supplied from the ink cartridges.

Figure 1:
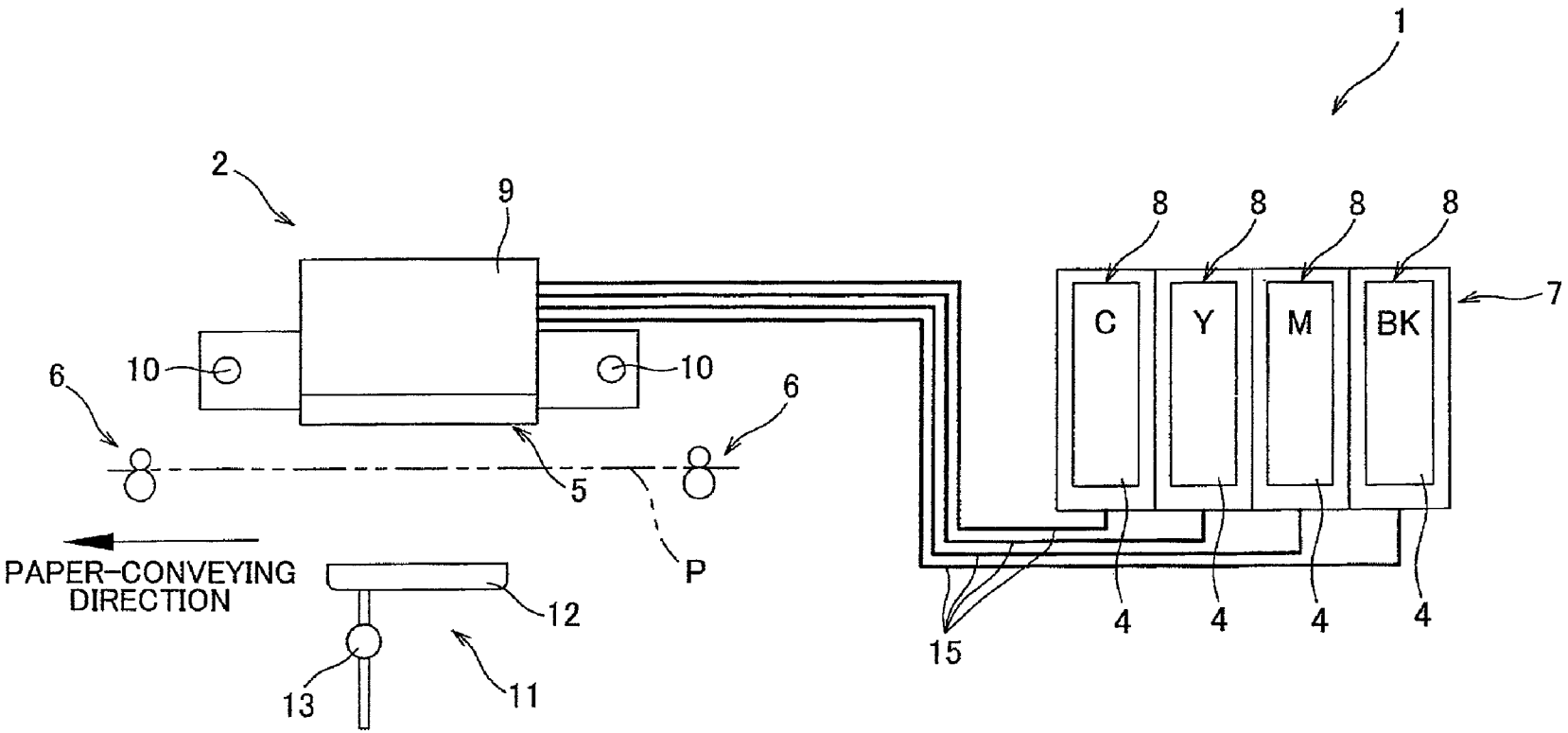
FIG. 1 is a configuration diagram diagrammatically showing an inkjet recording system according to an embodiment of a present invention.

As shown in FIG. 1, an inkjet recording system 1 according to a preferred embodiment includes an inkjet printer 2 (inkjet recording device) that records desired images and the like on a recording paper P by ejecting ink thereon, a control unit 3 (see FIG. 10) that controls the overall operations of the inkjet printer 2, and four ink cartridges 4 respectively storing ink of the four colors cyan (C), yellow (Y), magenta (M), and black (BK) used in the inkjet printer 2.

The inkjet printer 2 includes an inkjet head 5 having a plurality of nozzles (not shown) for ejecting ink droplets downward, a conveying mechanism 6 for conveying the recording paper P under the inkjet head 5 in a prescribed paper-conveying direction (leftward in FIG. 1), and a holder 7 having four cartridge-mounting units 8 for respectively mounting the four ink cartridges 4.

The inkjet head 5 is mounted on a carriage 9 capable of reciprocating along two guide shafts 10 extending in a direction perpendicular to the plane of the drawing in FIG. 1. The ink cartridges 4, each storing ink in one of the four colors, are detachably mounted in the four cartridge-mounting units 8 provided in the holder 7 in a prescribed mounting direction (the direction perpendicular to the plane of the drawing in FIG. 1). The four cartridge-mounting units 8 are connected to the inkjet head 5 by four tubes 15. Ink stored in the ink cartridges 4 is supplied to the inkjet head along respective tubes 15 when the ink cartridges 4 are mounted in the cartridge-mounting units 8.

The inkjet printer 2 is configured to eject ink in the four colors from the plurality of nozzles in the inkjet head 5 toward the recording paper P that the conveying mechanism 6 conveys leftward in FIG. 1, while moving the inkjet head 5 and the carriage 9 as a unit in the direction orthogonal to the plane of the drawing in FIG. 1, in order to record images and the like on the recording paper P.

The inkjet printer 2 also includes a purging mechanism 11 for sucking out ink with an excessive viscosity and air that contaminate ink channels in the inkjet head 5. The purging mechanism 11 is capable of moving toward and away from an ink ejection surface (bottom surface in FIG. 1) of the inkjet head 5 in which the nozzles are formed. The purging mechanism 11 includes a purge cap 12 capable of being mounting on the inkjet head 5 so as to cover the ink ejection surface, and a suction pump 13 for drawing out ink from the nozzles. By operating the suction pump 13 when the purge cap 12 is covering the ink ejection surface of the inkjet head 5, the purging mechanism 11 is configured to forcibly discharge, from the nozzles, air that has entered the ink channels and ink that has become highly viscous due to moisture evaporation.

Next, the ink cartridges 4 will be described with reference to FIGS. 2-7. Since the four ink cartridges 4 storing ink all have the same structure, the following description will focus on only one of the ink cartridges 4.

Figure 2:
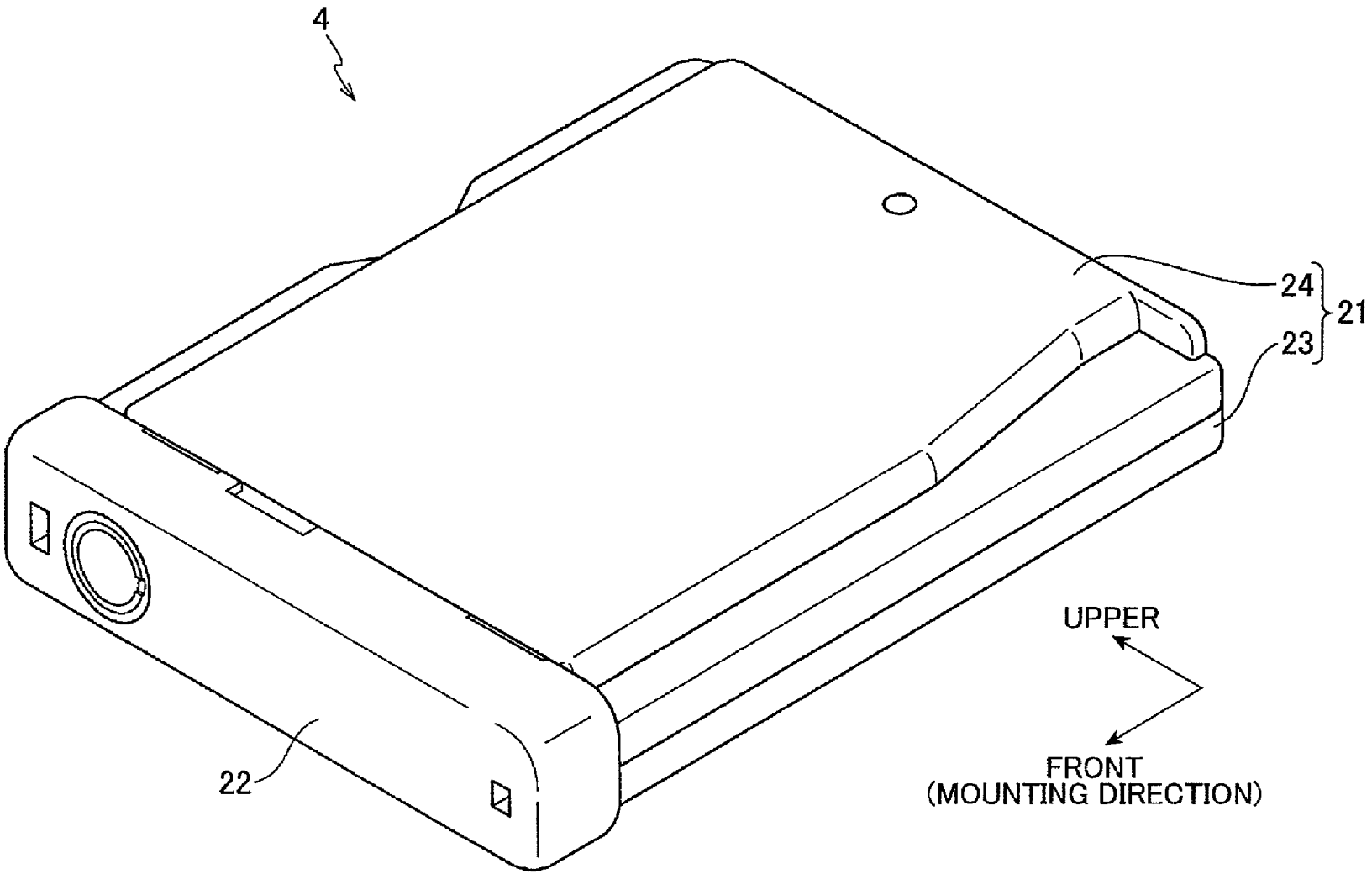
FIG. 2 is a perspective view showing an external structure of an ink cartridge.

As shown in FIG. 2, the ink cartridge 4 is shaped substantially like a hexahedron (parallelepiped). The two rectangular surfaces of the ink cartridge 4 having the greatest surface area among six rectangular surfaces oppose each other and are joined by the other four surfaces. With the two rectangular surfaces having the greatest surface area arranged vertically (the orientation shown in FIG. 4), the ink cartridge 4 is inserted into one of the cartridge-mounting units 8 of the holder 7 in a direction following the longitudinal dimensions of the two rectangular surfaces. In the following description of the ink cartridge 4, the direction following the longitudinal dimensions of the two rectangular surfaces aligned with the mounting direction of the ink cartridge 4 will be referred to as a "front-to-rear direction," and the latitudinal direction will be defined as a "vertical direction." A direction orthogonal to the two rectangular surfaces will be defined as a width direction of the ink cartridge 4.

Figure 3:
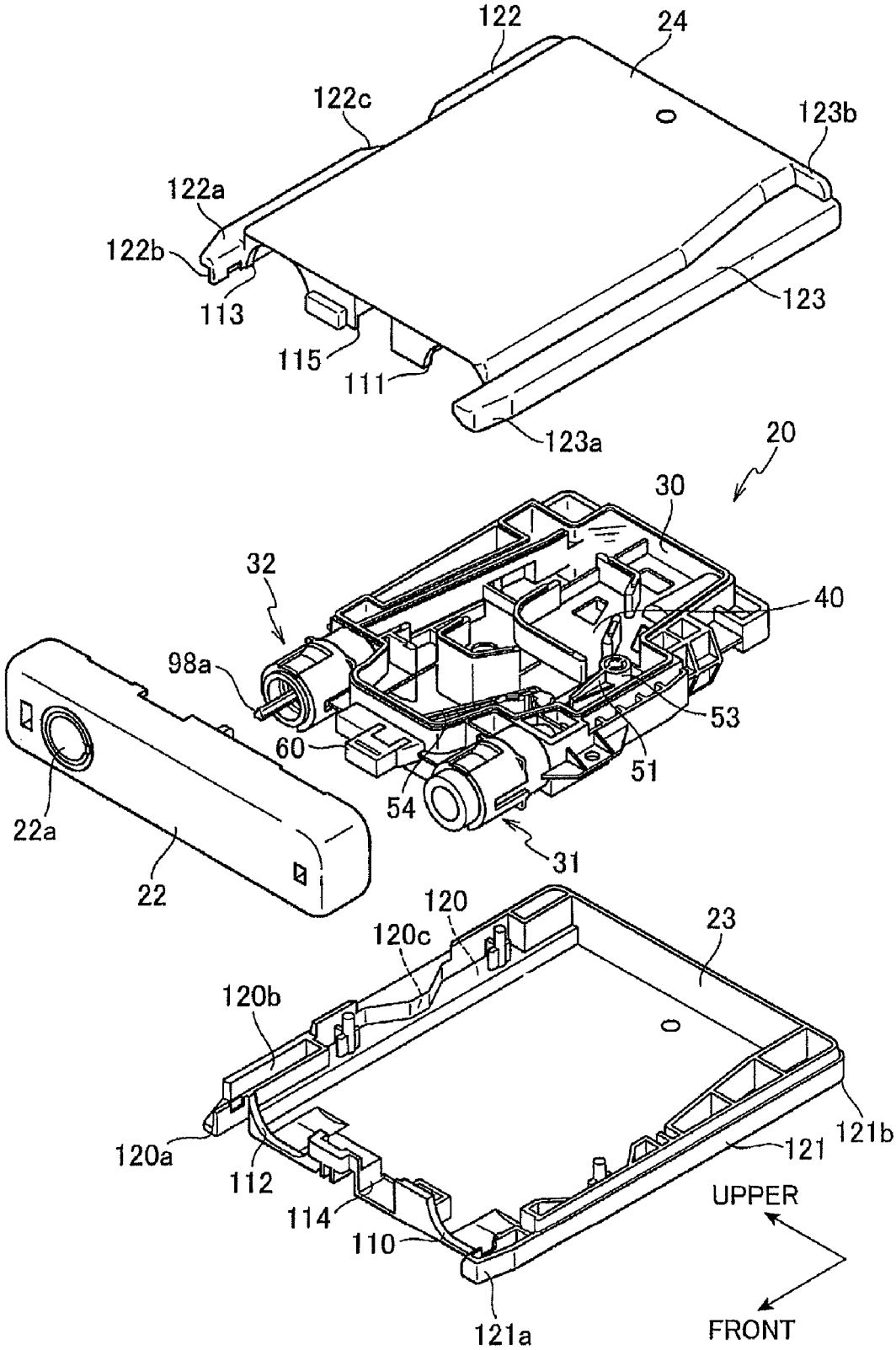
FIG. 3 is an exploded perspective view of the ink cartridge.

As shown in FIGS. 2 and 3, the ink cartridge 4 includes a cartridge body 20 accommodating ink, an outer case 21 covering substantially the entire cartridge body 20, and a protector 22 attached to the front end of the outer case 21. In the embodiment, the cartridge body 20, the outer case 21, and the protector 22 are each formed of a synthetic resin material such as nylon, polyethylene, or polypropylene.

First, the cartridge body 20 will be described. As shown in FIG. 3, the cartridge body 20 includes an ink-accommodating member 30 having an ink chamber 40 storing ink internally, an ink-outputting unit 31 provided on the bottom of the front part of the ink-accommodating member 30 for introducing ink into the front section of the ink chamber 40, and an air-introducing unit 32 provided on the top of the front portion of the ink-accommodating member 30 for introducing air into the front of the ink chamber 40.

Figure 4:
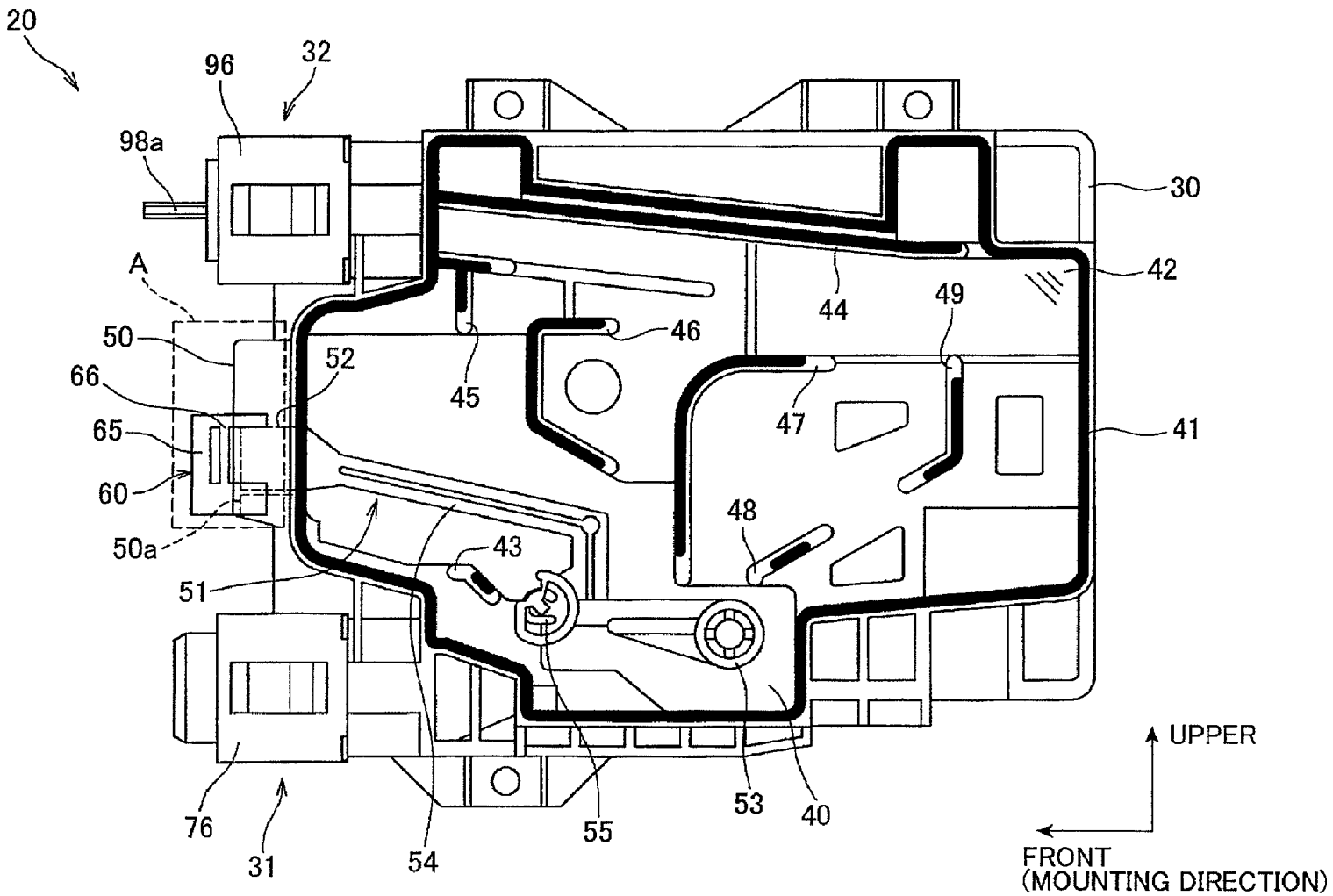
FIG. 4 is a side view of the cartridge body.

As shown in FIG. 4, the ink-accommodating member 30 includes a frame part 41, ribs 43-49 joined to the frame part 41, and two sheets of film 42 adhered to both sides (the near side and far side in FIG. 4) of the frame part 41 and the ribs 43-49 (particularly, the parts indicated by thick, dark lines in FIG. 4). The two films 42 seal both sides of a space defined by the frame part 41, which space constitutes the ink chamber 40 and functions to store ink. The films 42 are affixed to the frame part 41 and ribs 43-49 by ultrasonic welding, for example. This construction allows for a thinner ink-accommodating member 30 than when the entire ink chamber 40 is surrounded by rigid wall parts formed of a synthetic resin material. The ribs 43-49 are provided to compensate for the loss of strength caused by use of the films 42.

Figure 5:
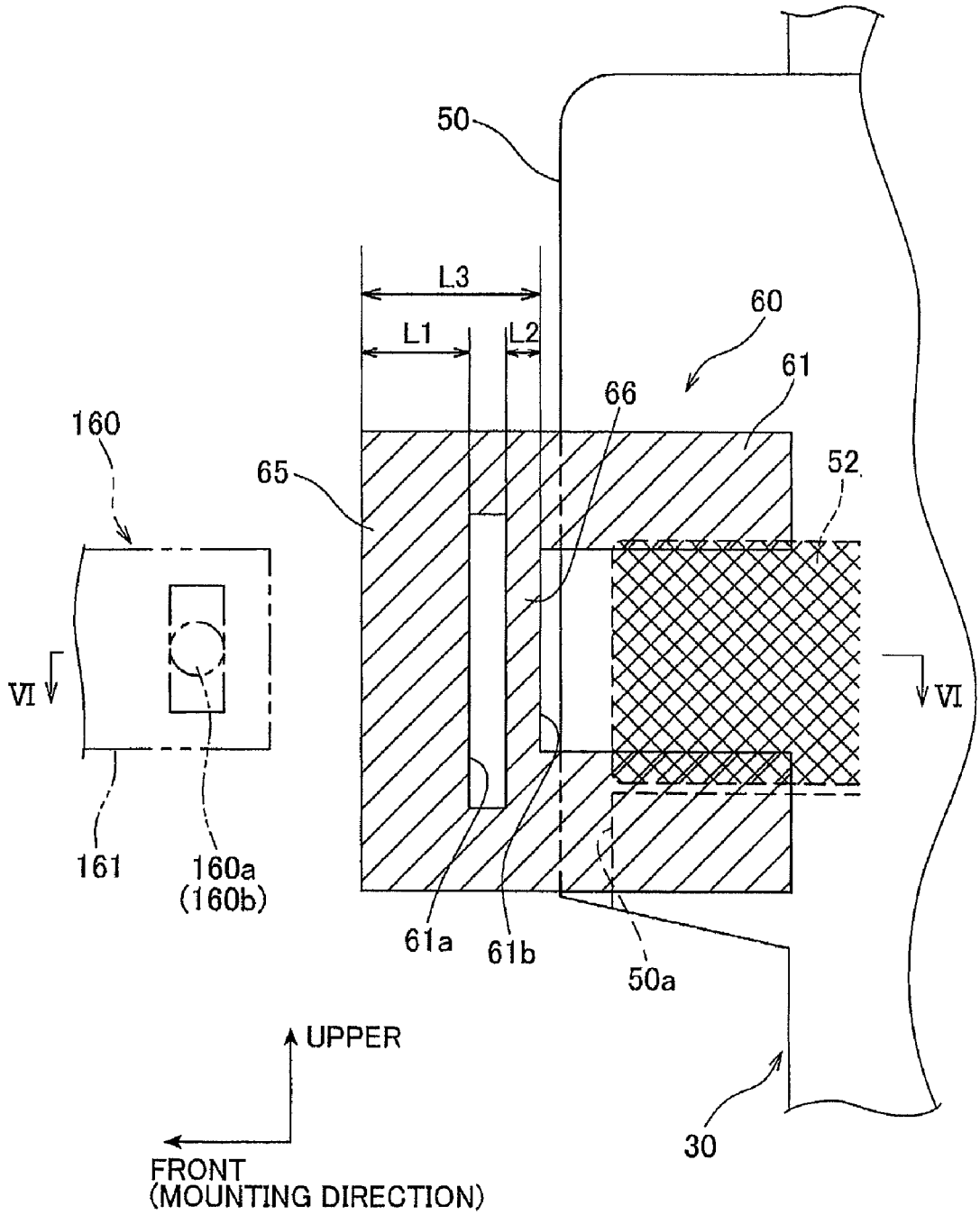
FIG. 5 is an enlarged view of a region A indicated in FIG. 4.

As shown in FIG. 4, a translucent detection part 50 is provided on the front end (left end in FIG. 4) of the ink-accommodating member 30 and protrudes farther forward (toward the downstream end in the mounting direction) than the frame part 41 on which the films 42 are welded. An internal space formed in the detection part 50 is in communication with the ink chamber 40 positioned to the rear thereof through the frame part 41. A sensor arm 51 described below that is provided in the ink chamber 40 has a light-shielding plate 52 that is capable of moving vertically within the detection part 50. When the ink cartridge 4 is mounted in the cartridge-mounting unit 8 of the holder 7 (see FIG. 8), the bottom end of the detection part 50 is positioned between a light-emitting element 160*a* and a light-receiving element 160*b* of a photosensor 160 described later (see FIG. 8). As shown in FIGS. 4 and 5, a stopper 50*a* is provided in the inner bottom end of the detection part 50 for restricting the light-shielding plate 52 of the sensor arm 51 from moving downward toward a position lower than the stopper 50*a*. A light-shielding member 60 formed of a light-shielding material is mounted on the lower half portion of the detection part 50 from the front thereof. The light-shielding member 60 will be described later in greater detail.

Figure 6:
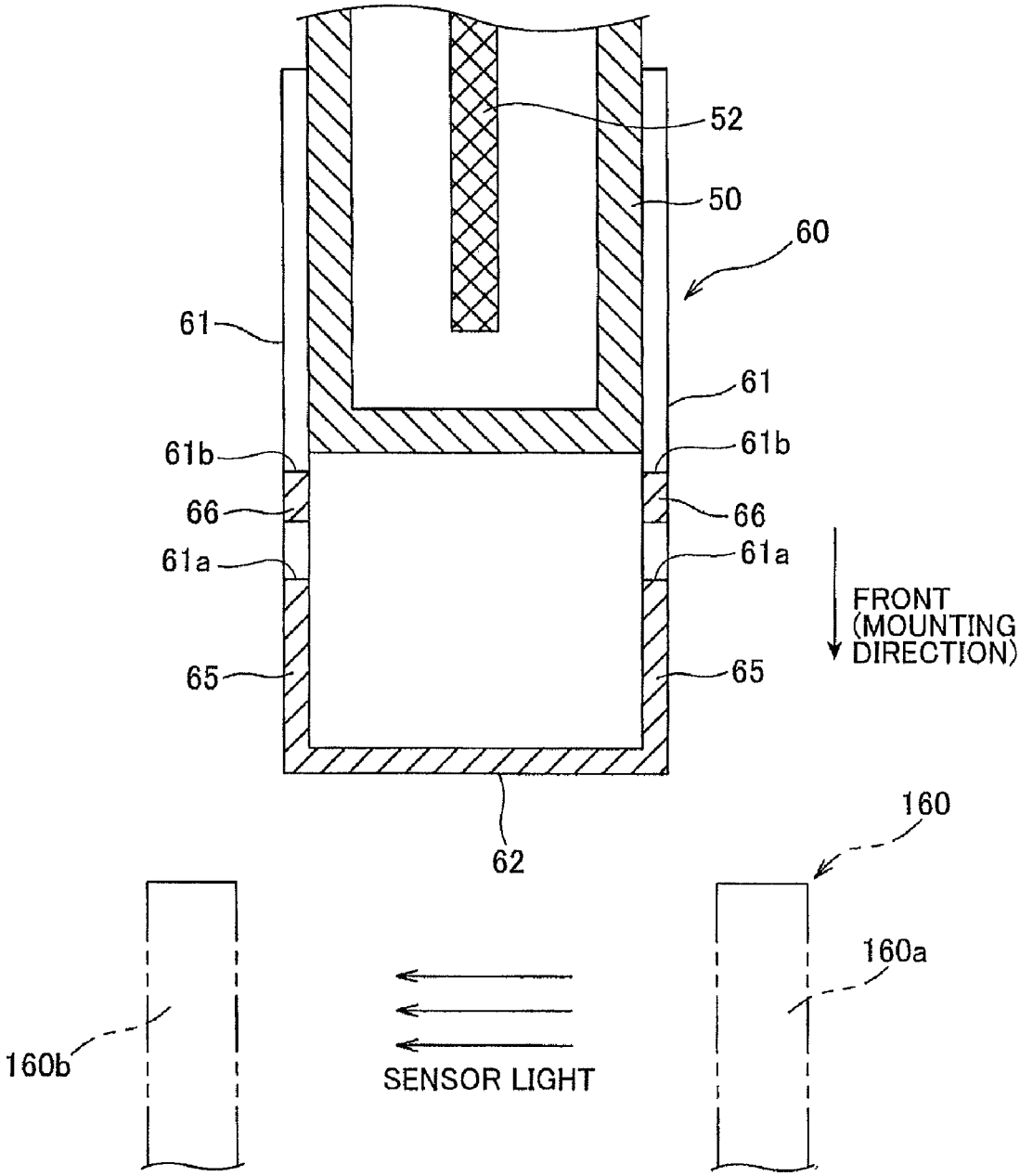
FIG. 6 is a cross-sectional view taken along the line VI-VI shown in FIG. 5.

The sensor arm 51 is provided in the lower half of the ink chamber 40 and pivots along with fluctuations in the ink level of the ink chamber 40 (the amount of residual ink). FIG. 5 is an enlarged view of the region A indicated in FIG. 4, and FIG. 6 is a cross-sectional view taken along the line VI-VI shown in FIG. 5. As shown in FIGS. 4-6, the sensor arm 51 includes the light-shielding plate 52 (second light-shielding part) capable of shielding light emitted from the photosensor 160 provided on the cartridge-mounting unit 8 described later, a float part 53, and an arm part 54 (coupling member) coupling the light-shielding plate 52 to the float part 53. The light-shielding plate 52, the float part 53, and the arm part 54 are integrally formed through injection molding or the like from a synthetic resin material having a low specific gravity (styrene resin, for example).

With one end coupled to the float part 53 (the rear end in FIG. 4) and the other end coupled to the light-shielding plate 52 (the front end in FIG. 4), the arm part 54 extends in a substantially horizontal direction from the float part 53 and subsequently slopes diagonally upward. The arm part 54 is pivotably supported on an arm support part 55 provided on the ink-accommodating member 30 so that the sensor arm 51 can pivot freely about the arm support part 55. The distance from the arm support part 55 to the distal end of the light-shielding plate 52 is slightly longer than the distance from the arm support part 55 to the distal end of the float part 53.

The light-shielding plate 52 is accommodated in the detection part 50 and moves vertically within the detection part 50 along with the pivoting of the sensor arm 51. When the ink cartridge 4 is mounted in the cartridge-mounting unit 8 and the light-shielding plate 52 is positioned on the bottom within the detection part 50, the photosensor 160 detects the light-shielding plate 52 because the light-shielding plate 52 blocks light emitted from the light-emitting element 160*a* of the photosensor 160 from passing through the detection part 50.

The volume of the float part 53 is sufficiently larger than the volume of the light-shielding plate 52. Further, as described above, the sensor arm 51 is formed of a material having a smaller specific gravity than the ink. Hence, the forces of gravity and buoyancy produce a moment about the arm support part 55 that is applied to the sensor arm 51. However, since the force of buoyancy applied to the float part 53 is sufficiently greater than the force of buoyancy applied to the light-shielding plate 52 when the entire float part 53 is submerged in ink, the moment acting in the counterclockwise direction of FIG. 4 is greater than the clockwise moment. By providing the stopper 50*a* on the inner bottom end of the detection part 50, the sensor arm 51 cannot float farther in the counterclockwise direction in FIG. 4 after the light-shielding plate 52 contacts the stopper 50*a*. In other words, when the entire float part 53 is submerged in ink (i.e., when there is sufficient residual ink), the light-shielding plate 52 is positioned on the bottom region inside the detection part 50 and blocks light emitted from the light-emitting element 160*a* of the photosensor 160.

When the level of ink in the ink chamber 40 drops with part of the float part 53 projecting above the ink level, the buoyancy generated in the float part 53 lessens and the counterclockwise moment becomes equivalent to the clockwise moment. As the ink level continues to drop after part of the float part 53 is exposed from the ink surface, the float part 53 begins to move downward in response to the change in ink level. Further, since the sensor arm 51 pivots (rotates) in the clockwise direction in FIG. 4 about the arm support part 55 as the float part 53 moves downward, the light-shielding plate 52 moves upward until the light-shielding plate 52 no longer blocks light emitted from the light-emitting element 160*a*. When the ink surface falls to a level near the bottom surface in the ink chamber 40, the float part 53 contacts this bottom surface, restricting the sensor arm 51 from rotating farther (from pivoting farther in the clockwise direction).

While mentioned above briefly, as shown in FIGS. 4-6, where the detection part 50 accommodates the light-shielding plate 52 so that the light-shielding plate 52 can move vertically in response to fluctuations in ink level. The light-shielding member 60 formed of a light-shielding material is mounted from the front side of the detection part 50 and fixed to the front end of the detection part 50. The light-shielding member 60 cannot move relative to the detection part 50 of the cartridge body 20. While the light-shielding plate 52 of the sensor arm 51 is provided for detecting the amount of residual ink, the light-shielding member 60 is provided for distinguishing whether the ink cartridge 4 is being mounted or removed.

The light-shielding member 60 is configured of two side wall parts 61 extending along the two side surfaces of the detection part 50 and protruding farther forward than the front end of the detection part 50, and a linking part 62 for linking the front ends of the two side wall parts 61 (see FIG. 6).

As shown in FIGS. 5 and 6, each side wall part 61 has a slit 61*a*, and a notched part 61*b* formed therein at an interval in the front-to-rear direction. In a side view, the slit 61*a* is rectangular-shaped and elongated vertically at a position offset rearward a prescribed distance from the front end of the side wall part 61. In a side view, the notched part 61*b* is a rectangular-shaped cutout portion in the side wall part 61 extending from the rear end of the side wall part 61 toward the front in the vertical center of the side wall part 61. The light-shielding member 60 is fixed to the detection part 50 with the two side wall parts 61 pinching the detection part 50 in the width direction at areas both above and below the notched parts 61*b*. The width (vertical dimension) of the notched part 61*b* is smaller than the same dimension of the slit 61*a* in order that the two side wall parts 61 can firmly grip the detection part 50.

As shown in FIG. 6, the positions of the slits 61*a* and the notched parts 61*b* in the two side wall parts 61 are respectively the same relative at least to the front-to-rear direction. Hence, light traveling in the width direction of the ink cartridge 4 (left-to-right direction in FIG. 6) can pass through the light-shielding member 60 at the position of the slits 61*a* or the notched parts 61*b*. More specifically, the side wall part 61 has two light-shielding parts (first light-shielding parts), that is, a light-shielding part 65 corresponding to a part of the side wall part 61 from the front end thereof to the slit 61*a*, and a light-shielding part 66 corresponding to a part of the side wall part 61 from the slit 61*a* to the front end of the notched part 61*b*. The light-shielding parts 65 and 66 are juxtaposed in the front-to-rear direction (the mounting direction and the ink-outputting direction of the ink-outputting unit 31). When the ink cartridge 4 is moved in the front-to-rear direction during mounting or removal, the light-shielding parts 65 and 66 sequentially block light emitted from the photosensor 160 on the cartridge-mounting unit 8. Since the light-shielding member 60 is mounted so as to be incapable of moving relative to the detection part 50, the positional relationships between the light-shielding parts 65 and 66 of the light-shielding member 60 and the detection part 50 do not change.

As shown in FIG. 5, a distance L1 from the front end of the side wall part 61 to the front end of the slit 61*a* is longer than a distance L2 from the rear end of the slit 61*a* to the front end of the notched part 61*b*. Hence, the light-shielding parts 65 and 66 have different dimensions in the front-to-rear direction. That is, the front-to-rear dimension of the light-shielding part 65 positioned on the front side is greater than the front-to-rear dimension of the light-shielding part 66 positioned on the rear side. More specifically, the front light-shielding part 65 has a front-to-rear dimension at least three times that of the rear light-shielding part 66.

The light-shielding parts 65 and 66 have different dimensions in the front-to-rear direction. Thus; while the ink cartridge 4 moves in the front-to-rear direction during mounting or removal, the length of time in which light emitted from the photosensor 160 on the cartridge-mounting unit 8 is blocked by the front light-shielding part 65 is different from the length of time in which light emitted from the photosensor 160 is blocked by the rear light-shielding part 66. Further, light is interrupted in order of the front light-shielding part 65 and the rear light-shielding part 66 when the ink cartridge 4 is mounted. Whereas, light is interrupted in order of the rear light-shielding part 66 and the front light-shielding part 65 when the ink cartridge 4 is removed. Therefore, the photosensor 160 outputs a different waveform during mounting and removal, making it possible to determine whether the ink cartridge 4 has been mounted or removed.

As shown in FIG. 5, the notched parts 61*b* are areas of the light-shielding member 60 through which light from the photosensor 160 can pass partially. The notched parts 61*b* overlap the bottom end of the detection part 50 in the front-to-rear direction. Therefore, when the light-shielding plate 52 of the sensor arm 51 is positioned in the bottom of the detection part 50 (i.e., when there is sufficient residual ink), the light-shielding parts 65 and 66 and the light-shielding plate 52 of the sensor arm 51 are aligned in the front-to-rear direction (mounting direction). Further, the front end of the notched part 61*b* (i.e., the rear end of the rear light-shielding part 66) is positioned forward of the front end of the light-shielding plate 52 when the light-shielding plate 52 is in the bottom of the detection part 50. The rear light-shielding part 66 and light-shielding plate 52 are separated by a gap in the front-to-rear direction. Accordingly, it is possible to detect whether the ink cartridge 4 is being mounted or removed based on how the light-shielding parts 65 and 66 block light emitted from the light-emitting element 160*a* of the photosensor 160. Further, it is possible to detect the amount of residual ink according to whether the light-shielding plate 52 blocks light emitted from the light-emitting element 160*a* after the ink cartridge 4 has been mounted.

Figure 7:
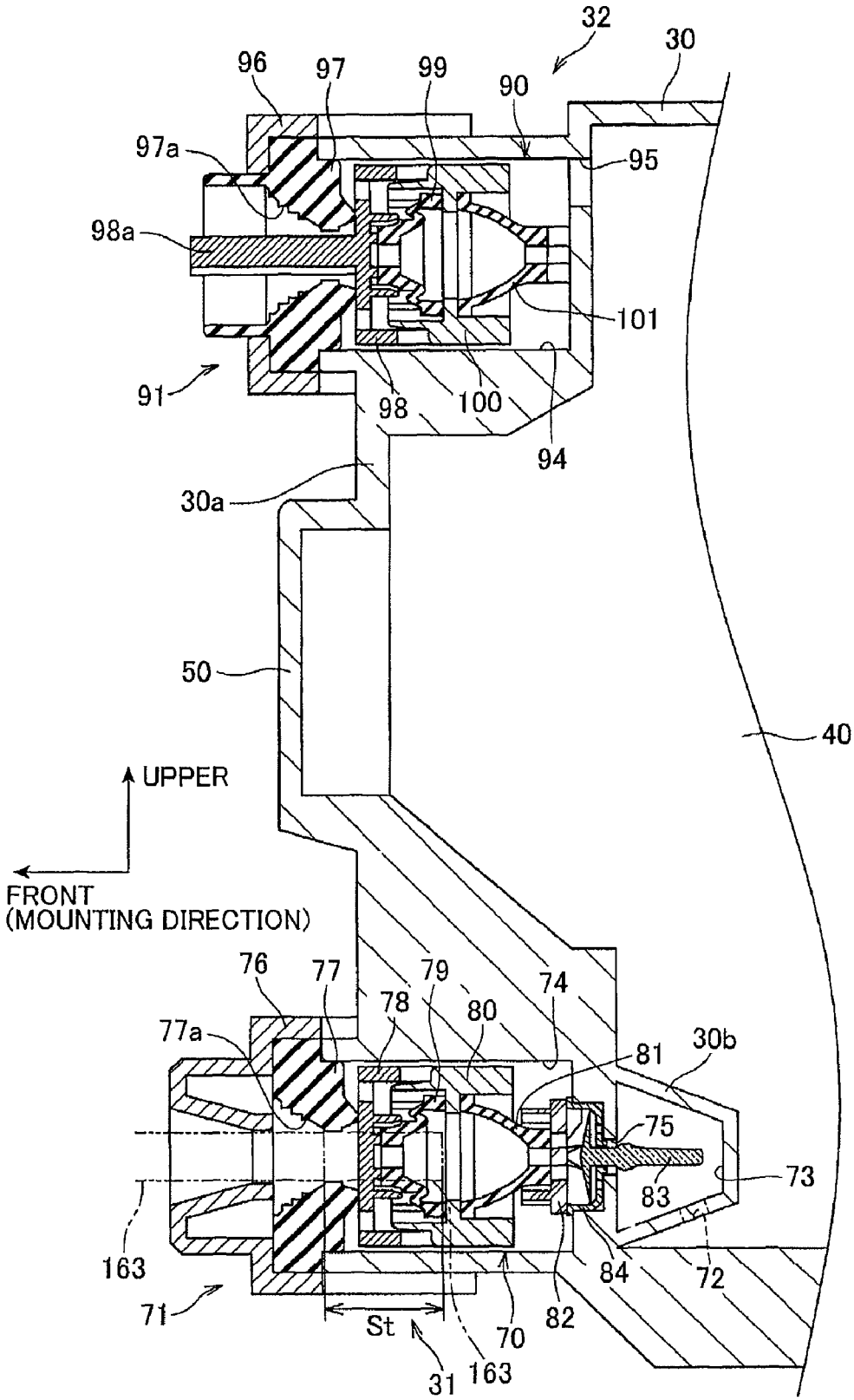
FIG. 7 is a cross-sectional view taken along a vertical plane showing a front end of the cartridge body including an ink-outputting unit and an air-introducing unit.

Next, the ink-outputting unit 31 and the air-introducing unit 32 will be described. As shown in FIG. 7, the ink-outputting unit 31 and the air-introducing unit 32 extend horizontally forward from respective bottom and top ends of a front wall part 30*a* (the downstream wall part in the mounting direction) constituting part of the ink-accommodating member 30. The ink-outputting unit 31 and the air-introducing unit 32 are positioned on either side of the detection part 50 with respect to the vertical direction. The air-introducing unit 32 introduces air into the ink chamber 40 formed in the ink-accommodating member 30 from the front side thereof, while the ink-outputting unit 31 supplies ink from the ink chamber 40 toward the front side thereof. The sensor arm 51 described above has been omitted from the drawing in FIG. 7.

When the ink cartridge 4 is mounted in the cartridge-mounting unit 8, the air-introducing unit 32 is positioned on the top end of the ink-accommodating member 30, and the ink-outputting unit 31 is positioned on the bottom end of the ink-accommodating member 30. Hence, the air-introducing unit 32 smoothly introduces air into the upper space of the ink chamber 40, making it possible to discharge the maximum amount of ink stored in the bottom space of the ink chamber 40.

As shown in FIG. 7, the ink-outputting unit 31 includes an ink-outputting channel 70 in communication with the ink chamber 40, and a first opening/closing mechanism 71 for opening and closing the ink-outputting channel 70. The ink-outputting channel 70 includes an ink supply chamber 73 defined by a partition 30*b* provided on the front wall part 30*a* of the ink-accommodating member 30 and in communication with the ink chamber 40 via a through-hole 72 formed in the partition 30*b*, a first accommodating chamber 74 formed in the front wall part 30*a* of the ink-accommodating member 30 and open on the front side for accommodating the majority of the first opening/closing mechanism 71, and a through-hole 75 formed in the front wall part 30*a* for providing communication between the ink supply chamber 73 and the first accommodating chamber 74. The ink-outputting channel 70, as a whole, extends substantially horizontally toward the front. Ink in the ink chamber 40 flows from the ink supply chamber 73 into the first accommodating chamber 74 via the through-hole 75.

The first opening/closing mechanism 71 includes a feed cap 76, a feed joint 77 (joint part), a feed valve 78 (valve member), a first feed spring 79 (urging member), a feed slider 80, a second feed spring 81 (urging member), a valve seat 82, a check valve 83, and a cover 84.

The feed cap 76 is mounted on the front end of the ink-accommodating member 30 so as to cover the first accommodating chamber 74. The feed joint 77 is configured of an elastic material such as rubber in an annular shape with a through-hole 77*a* formed in the center thereof. The feed joint 77 seals the open end of the first accommodating chamber 74, which is the outlet of the ink-outputting channel 70. The feed valve 78 is capable of moving in the front-to-rear direction within the first accommodating chamber 74 between a closed position and an open position. In the closed position, the feed valve 78 closes the ink-outputting channel 70 by sealing the through-hole 77*a* in the feed joint 77. Specifically, the feed valve 78 contacts the rear end of the feed joint 77 in the closed position. In the open position, the feed valve 78 opens the ink-outputting channel 70 by separating from the feed joint 77.

The first and second feed springs 79 and 81 are disposed in confrontation with each other, with the feed slider 80 interposed therebetween. The first and second feed springs 79 and 81 are formed of the same material in substantially the same bowl shape. The front end of the first feed spring 79 contacts the feed valve 78. The rear end of the second feed spring 81 contacts the valve seat 82. The feed slider 80 is disposed on the rear side of the feed valve 78 (rightward in FIG. 7). The feed slider 80 is capable of moving in the front-to-rear direction within the first accommodating chamber 74. The feed slider 80 is urged forward by the second feed spring 81. Specifically, the second feed spring 81 urges the feed slider 80 forward. The urging force of the feed slider 80 is applied to the feed valve 78 via the first feed spring 79. Consequently, the feed valve 78 is urged forward toward the closed position for blocking the through-hole 77*a* formed in the feed joint 77.

The valve seat 82 contacts the rear end of the second feed spring 81 and supports the check valve 83. The check valve 83 is disposed near the through-hole 75 and prevents ink from flowing in reverse from the first accommodating chamber 74 to the ink supply chamber 73. The cover 84 covers the portion of the check valve 83 between the cover 84 and valve seat 82.

When the ink cartridge 4 is not mounted in the cartridge-mounting unit 8, the front surface of the feed valve 78 being urged forward contacts the rear end of the feed joint 77, and the feed valve 78 closes the through-hole 77*a* in the feed joint 77. Thereby, this configuration reliably prevents ink from leaking out of the ink-outputting unit 31. On the other hand, when the ink cartridge 4 is mounted in the cartridge-mounting unit 8, an ink extraction tube 163 of the cartridge-mounting unit 8 described later is inserted into the through-hole 77*a* of the feed joint 77 in the front-to-rear direction, and the leading end of the ink extraction tube 163 pushes the feed valve 78 plugging up the through-hole 77*a* rearward against the urging force of the second feed spring 81. Hence, the feed valve 78 separates from the feed joint 77, opening the through-hole 77*a* and allowing ink to be introduced from the ink chamber 40 into the ink extraction tube 163 via the ink-outputting channel 70. When the ink cartridge 4 is completely mounted in the cartridge-mounting unit 8 (see FIG. 9(*c*)), pressure from the ink extraction tube 163 urges the feed valve 78 into the open position. At this time, the pressure of the ink extraction tube 163 is applied to the feed slider 80 via the feed valve 78 and the first feed spring 79, causing the feed slider 80 to slide rearward against the urging force of the second feed spring 81. In other words, the feed slider 80 moves rearward, and the feed valve 78 moves to the open position due to the contraction of the first feed spring 79 and second feed spring 81.

As shown in FIG. 7, the air-introducing unit 32 includes an air-introducing channel 90 in communication with the ink chamber 40 within the ink-accommodating member 30, and a second opening/closing mechanism 91 for opening and closing the air-introducing channel 90. The air-introducing channel 90 is formed in the front wall part 30*a* of the ink-accommodating member 30 and is open on the front side. The air-introducing channel 90 includes a second accommodating chamber 94 accommodating the majority of the second opening/closing mechanism 91, and a through-hole 95 formed in the front wall part 30*a* for providing communication between the ink chamber 40 and the second accommodating chamber 94. The air-introducing channel 90, as a whole, extends substantially along the horizontal toward the front and functions to introduce air into the ink chamber 40 via the second accommodating chamber 94 and through-hole 95.

The second opening/closing mechanism 91 includes an air cap 96, an air joint 97, an air valve 98, a first air spring 99, an air slider 100, and a second air spring 101.

The air cap 96 is mounted on the front end of the ink-accommodating member 30 so as to cover the second accommodating chamber 94. The air joint 97 is formed of an elastic material such as rubber in an annular shape having a through-hole 97*a* formed in the center thereof. The air joint 97 plugs up the open end of the second accommodating chamber 94, which is the outlet of the air-introducing channel 90. The air valve 98 is disposed in the second accommodating chamber 94 and is capable of moving in the front-to-rear direction therein, between a closed position (forward position) for plugging up the through-hole 97*a* of the air joint 97 to close the air-introducing channel 90, and an open position (rearward position) for separating from the air joint 97 to open the air-introducing channel 90. Specifically, in the closed position, the air valve 98 contacts the rear end of the air joint 97. In the open position, the air valve 98 is positioned rearward of the closed position. A protruding part 98*a* is provided on the air valve 98. The protruding part 98*a* extends forward from the front surface of the air valve 98 through the through-hole 97*a* of the air joint 97 and protrudes farther forward than the air cap 96 and air joint 97.

The first air spring 99 and the second air spring 101 are disposed one on either side of the air slider 100 so as to confront each other. The first air spring 99 and the second air spring 101 are formed of the same material and in a substantially identical bowl shape. The front end of the first air spring 99 contacts the air valve 98. The rear end of the second air spring 101 contacts the recessed end (inner rear side) of the second accommodating chamber 94. The air slider 100 is disposed to the rear of the air valve 98 (rightward in FIG. 7) and is capable of moving in the front-to-rear direction within the second accommodating chamber 94. The second air spring 101 urges the air slider 100 in a forward direction. Specifically, the second air spring 101 urges the air slider 100 forward, and this urging force is further applied to the air valve 98 via the first air spring 99. Consequently, the air valve 98 is urged forward toward the closed position for plugging up the through-hole 97*a* in the air joint 97.

When the ink cartridge 4 is not mounted in the cartridge-mounting unit 8, the front surface of the air valve 98 being urged forward contacts the rear surface of the air joint 97 and closes the through-hole 97*a* formed in the air joint 97. Thereby, ink in the ink chamber 40 is prevented from drying. However, when the ink cartridge 4 is mounted in the cartridge-mounting unit 8, the protruding part 98*a* of the air valve 98 contacts a mounting surface 156 of the cartridge-mounting unit 8 (see FIGS. 8 and 9). By this contact, the air valve 98 is pressed rearward against the urging force of the second air spring 101. Consequently, the air valve 98 separates from the air joint 97, opening the air-introducing channel 90 (second accommodating part) and allowing air to be introduced into the ink chamber 40 via the air-introducing channel 90.

Next, the outer case 21 will be described with reference to FIGS. 2 and 3. The outer case 21 is a block-like body similar in shape to a rectangular parallelepiped configured of two case members (a first case member 23 and a second case member 24) enclosing the ink-accommodating member 30 from both sides in the width direction. The first case member 23 covers the bottom surface of the ink-accommodating member 30 with respect to the orientation shown in FIG. 3. The second case member 24 covers the top surface with respect to the orientation shown in FIG. 3. The first and second case members 23 and 24 are formed of a synthetic resin material through injection molding or the like.

The first and second case members 23 and 24 are formed in substantially the same shape and have respective notch parts 110 and 111 and notch parts 112 and 113 formed in the front ends thereof so as to fit over both sides of the ink-accommodating member 30 in the width direction. The notch parts 110 and 111 configure a substantially circular through-hole through which part of the ink-outputting unit 31 is exposed. The notch parts 112 and 113 configure a substantially circular through-hole through which part of the air-introducing unit 32 is exposed. The first and second case members 23 and 24 also have respective notch parts 114 and 115 formed in the front end thereof so as to be positioned on either side of the detection part 50 and light-shielding member 60 (see FIGS.

4-6). The notch parts 114 and 115 configure a through-hole for inserting the photosensor 160 provided on the cartridge-mounting unit 8 (see FIG. 6).

Step parts 120 and 121 are provided respectively on upper and lower edges of the first case member 23 (edges on both sides with respect to the lateral direction of the ink cartridge 4). The step parts 120 and 121 are positioned a level lower than the surface of the first case member 23 and extend in the front-to-rear direction (longitudinal dimension of the ink cartridge 4). Similarly, step parts 122 and 123 are formed respectively on upper and lower edges of the second case member 24. The step parts 122 and 123 are positioned a level lower than the surface of the second case member 24 and extend along the front-to-rear direction. The first and second case members 23 and 24 are welded to each other at the step parts 120-123. That is, the step part 120 on the upper edge of the first case member 23 (the side nearest the air-introducing unit 32 and shown in the far left in FIG. 3) is welded to the step part 122 on the upper edge of the second case member 24, while the step part 121 on the lower edge of the first case member 23 (the side nearest the ink-outputting unit 31 and shown in the near right in FIG. 3) is welded to the step part 123 on the lower edge of the second case member 24. The step parts 120-123 have respective protruding parts 120*a*-123*a* that protrude farther forward than the front edges of the first and second case members 23 and 24. Fitting grooves 120*b* and 122*b* are formed in the protruding parts 120*a* and 122*a* and extend rearward.

Further, an engaging part 123*b* extends downward from the second case member 24 along the rear edge of the step part 123. The engaging part 123*b* protrudes outward from the surface of the step part 123 to a height flush with the surface of the second case member 24. As shown in FIG. 3, an engaging part 121*b* identical to the engaging part 123*b* is formed on the step part 121 of the first case member 23. Recessed engaging parts 120*c* and 122*c* are respectively formed in the step part 120 provided on the upper edge of the first case member 23 and the step part 122 provided on the upper edge of the second case member 24 in approximately center positions relative to the front-to-rear direction.

Next, the protector 22 will be described with reference to FIGS. 2 and 3. The protector 22 covers the front end of the ink-accommodating member 30 on which the ink-outputting unit 31 and the air-introducing unit 32 are provided. This protector 22 serves to protect the ink-outputting unit 31 and the air-introducing unit 32 when the ink cartridge 4 is shipped. As shown in FIG. 3, a protector through-hole 22*a* is formed in the protector 22 at a position corresponding to the air-introducing unit 32 (the far left in FIG. 2). The protector 22 covers the ink-outputting unit 31 with the protruding part 98*a* inserting into the protector through-hole 22*a*. That is, the protector 22 can cover the air-introducing unit 32 while allowing the protruding part 98*a* to extend into the protector through-hole 22*a*. Accordingly, the protector 22 can reliably protect both the ink-outputting unit 31 and the air-introducing unit 32. The ink cartridge 4 is mounted in the cartridge-mounting unit 8 of the holder 7 described below after the protector 22 has been removed (i.e., when the ink-outputting unit 31 and the air-introducing unit 32 are exposed).

Figure 8:
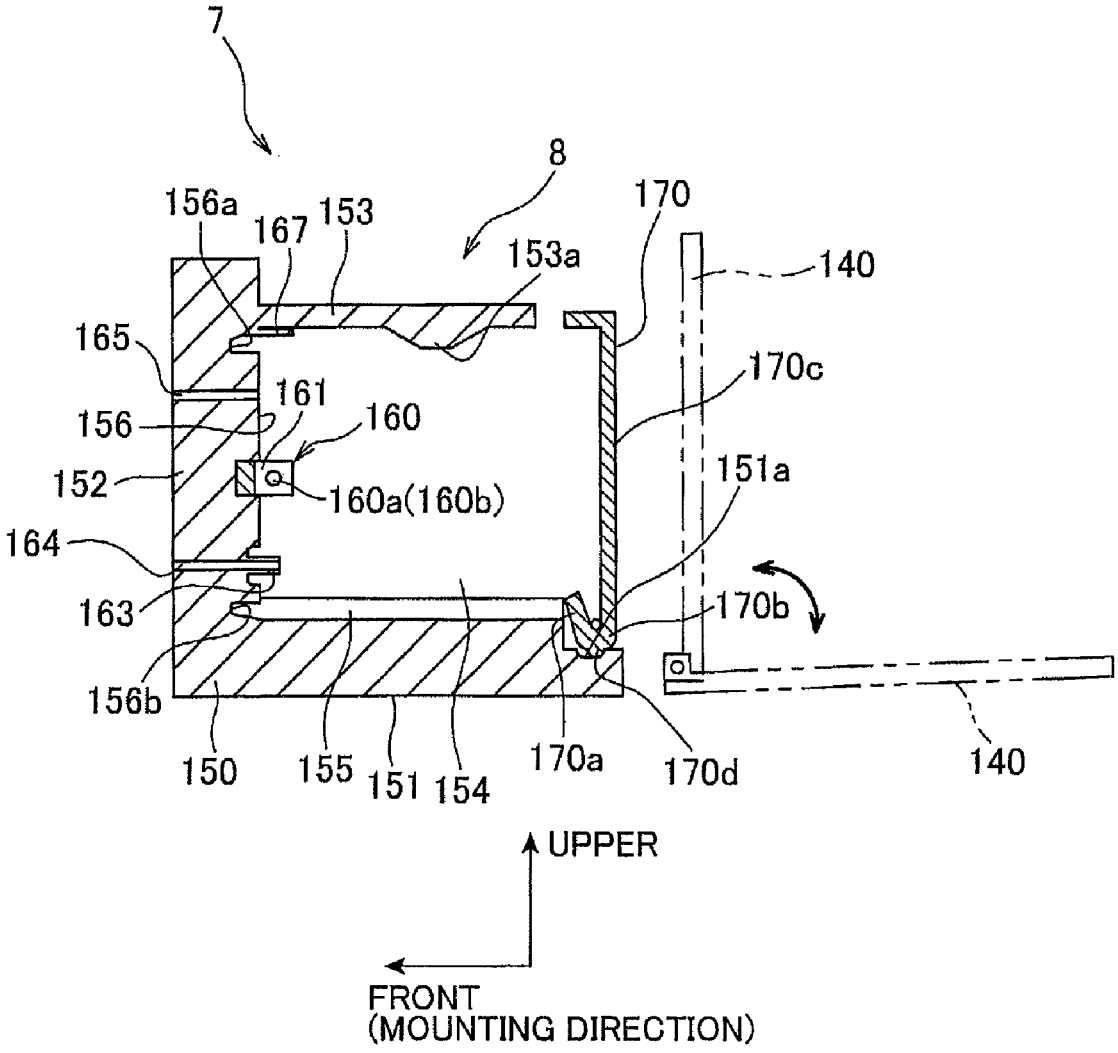
FIG. 8 is a cross-sectional view of a holder (cartridge mounting unit) taken along a vertical plane.

Next, the holder 7 on the inkjet printer 2 side will be described. The holder 7 functions to detachably mount the ink cartridges 4 described above. FIG. 8 is a cross-sectional view of the holder 7 conceptually illustrated in FIG. 1 along a vertical plane parallel to the mounting direction of the ink cartridge 4 (a direction orthogonal to the plane of the drawing in FIG. 1).

As shown in FIGS. 1 and 8, the ink-outputting channel 70 has a holder body 150 shaped substantially like a rectangular parallelepiped. The four cartridge-mounting units 8 are juxtaposed horizontally in the holder body 150. As shown in FIG. 8, a cover 140 is provided on the outside of the holder body 150. The cover 140 can rotate between a closed position and an open position. In the closed position, the cover 140 covers all four cartridge-mounting units 8. In the open position, the cover 140 exposes the four cartridge-mounting units 8. A cover open/close sensor 180 (see FIG. 10) detects the open/closed state of the cover 140 and transmits this state to the control unit 3.

Since the four cartridge-mounting units 8 all have the same construction, only one of the cartridge-mounting units 8 will be described below. As shown in FIG. 8, the cartridge-mounting unit 8 includes a level bottom part 151, an inner wall part 152 extending vertically upward from the inner edge of the bottom part 151 (the left edge in FIG. 8, which is the downstream edge in the mounting direction), and an engaging bar 153 extending rearward from the upper edge of the inner wall part 152. The engaging bar 153 extends substantially parallel to and opposite the bottom part 151. A cartridge-accommodating chamber 154 is formed inside the bottom part 151, the inner wall part 152, and the engaging bar 153, for respectively accommodating the ink cartridge 4.

A support part 155 supports the bottom of the mounted ink cartridge 4. The support part 155 is formed in the top surface of the bottom part 151 in a recessed shape corresponding to the step parts 121 and 123 on the bottom of the outer case 21 (see FIG. 3). A protruding part 153*a* protrudes downward from a midpoint of the engaging bar 153 along the longitudinal dimension thereof. The protruding part 153*a* has a shape corresponding to the recessed engaging parts 120*c* and 122*c* on the top of the outer case 21 (see FIG. 3)

The inner surface of the inner wall part 152 serves as the mounting surface 156. The mounting surface 156 contacts the front surface of the ink cartridge 4 accommodated in the cartridge-accommodating chamber 154. The photosensor 160 (optical cartridge-detecting means) is disposed at a position slightly below the vertical center of the mounting surface 156. The photosensor 160 has the light-emitting element 160*a*, and the light-receiving element 160*b* for receiving light emitted from the light-emitting element 160*a*. The light-emitting element 160*a* and the light-receiving element 160*b* are disposed one on either end of a sensor-mounting unit 161 so as to oppose each other in the width direction of the ink cartridge 4 (a direction orthogonal to the plane of the drawing in FIG. 8). The sensor-mounting unit 161 has a squared C-shape in a plan view. The photosensor 160 is disposed so as to protrude from the mounting surface 156. When the ink cartridge 4 is mounted in the cartridge-mounting unit 8, the light-emitting element 160*a* and the light-receiving element 160*b* of the photosensor 160 are inserted into the through-hole (configured by the notch parts 114 and 115) formed in the front end of the outer case 21 shown in FIG. 3. The photosensor 160 is a transmission-type photosensor. The photosensor 160 outputs a signal (ON) to the control unit 3 when an object of detection interrupts light emitted from the light-emitting element 160*a* so that the light-receiving element 160*b* does not receive light. Whereas the photosensor 160 does not output a signal (OFF state) when the light-receiving element 160*b* receives light emitted from the light-emitting element 160*a*.

The mounting surface 156 is provided with an ink extraction tube 163 protruding horizontally at a position lower than the photosensor 160 (a position corresponding to the ink-outputting unit 31 of the ink cartridge 4). The ink extraction tube 163 is in communication with an ink channel 164 formed in the inner wall part 152 and is further connected to the inkjet head 5 via the tube 15 (see FIG. 1). As will be described later, by inserting the ink extraction tube 163 into the ink-outputting unit 31 when the ink cartridge 4 is mounted, the ink extraction tube 163 pushes the feed valve 78 (see FIG. 7) in the open direction for opening the ink-outputting channel 70. The mounting surface 156 is formed as a flat surface in a position above the photosensor 160 (the position corresponding to the air-introducing unit 32 of the ink cartridge 4). An air communication channel 165 is formed in the inner wall part 152 and is open in the mounting surface 156 near the flat surface thereof.

A recessed part 156*a* and a recessed part 156*b* are formed in the respective upper and lower edges of the mounting surface 156. The recessed part 156*a* corresponds to the protruding parts 120*a* and 122*a* of the outer case 21 shown in FIG. 3, while the recessed part 156*b* corresponds to the protruding parts 121*a* and 123*a*. A fitting rod 167 is disposed at a position adjacent to the recessed part 156*a* at the top edge of the mounting surface 156 (the engaging bar 153 side). The fitting rod 167 extends rearward so as to be inserted into the fitting grooves 120*b* and 122*b* of the outer case 21.

A cover member 170 is disposed on the distal end of the bottom part 151 (the entrance to the cartridge-accommodating chamber 154). The cover member 170 rotates while engaged with the engaging parts 121*b* and 123*b* of the outer case 21 shown in FIG. 3. The cover member 170 has an engaging end part 170*a*, a pivotal support part 170*b*, and a cover part 170*c*. The engaging end part 170*a* engages with the engaging parts 121*b* and 123*b*. The pivotal support part 170*b* is formed continuously from the engaging end part 170*a* and is pivotally supported in the bottom part 151. The cover part 170*c* extends upward from the pivotal support part 170*b* for covering the rear surface of the mounted ink cartridge 4. A protruding part 170*d* is formed on the peripheral surface of the pivotal support part 170*b* and protrudes radially outward from the pivotal axis of the cover member 170. By engaging the protruding part 170*d* in a recessed part 151*a* formed in a distal end of the bottom part 151, the cover member 170 is incapable of rotating relative to the bottom part 151. In this way, the cover member 170 locks the ink cartridge 4 accommodated in the cartridge-accommodating chamber 154 so that the ink cartridge 4 cannot move forward or rearward. The cover member 170 and the recessed part 151*a* of the bottom part 151 preventing the cover member 170 from rotating correspond to the locking mechanism of the invention for maintaining the ink cartridge 4 in a locked state.

Next, the operations of the ink cartridge 4 and the cartridge-mounting unit 8 when mounting the ink cartridge 4 will be described with reference to FIGS. 8 and 9. Here, the ink cartridge 4 is mounted in the cartridge-mounting unit 8 after removing the protector 22.

To mount the ink cartridge 4 in a cartridge-mounting unit 8, the operator first pulls the cover 140 covering the four cartridge-mounting units 8 in the holder 7 downward (rearward), i.e., rotates the cover 140 into the open position, as illustrated in FIG. 8. The cover open/close sensor 180 (see FIG. 10) detects the opening of the cover 140 and conveys this detection to the control unit 3. Next, the operator rotates the cover part 170*c* of the cover member 170 for the prescribed cartridge-mounting unit 8 downward (rearward), exposing the cartridge-accommodating chamber 154.

Figure 9A:
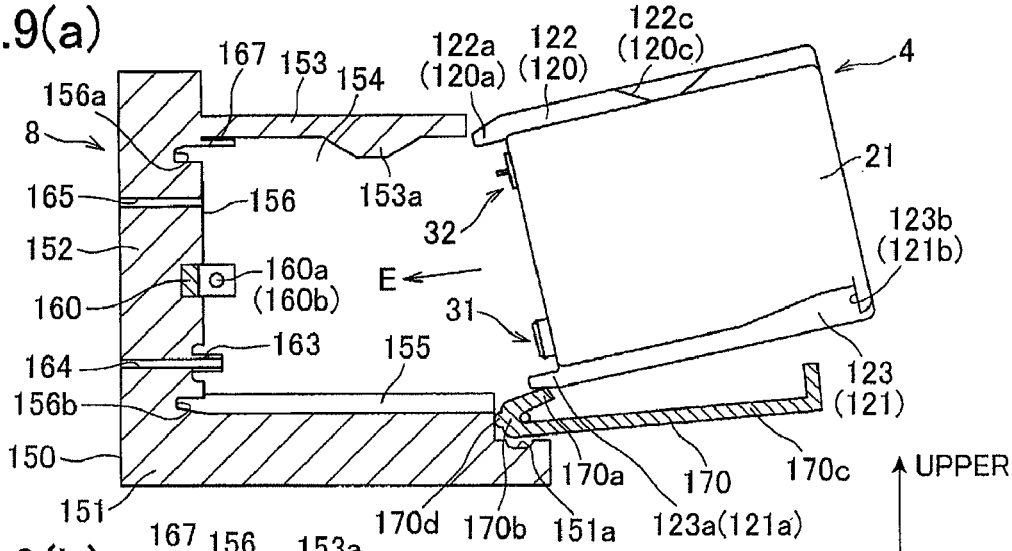
FIG. 9(*a*) is an explanatory diagram showing an operation of the ink cartridge and the cartridge mounting unit when an installation starts.
Figure 9B:
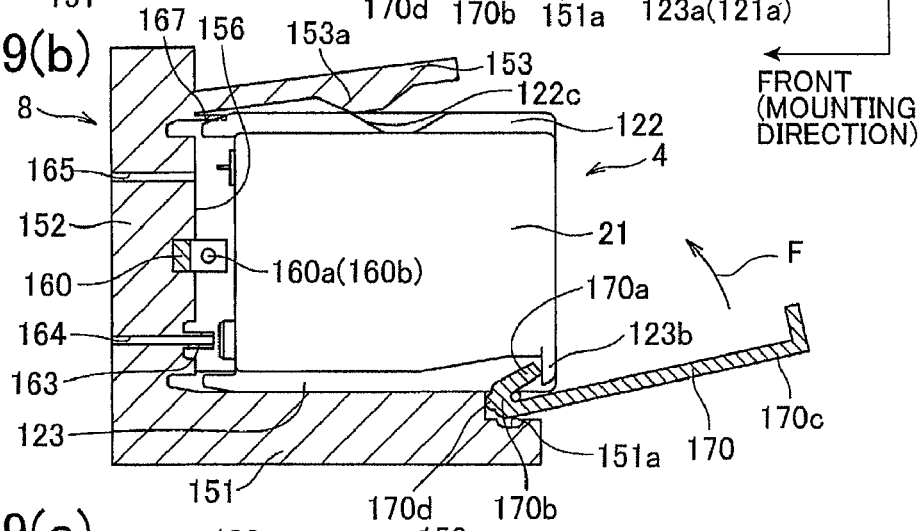
Figure 9C:
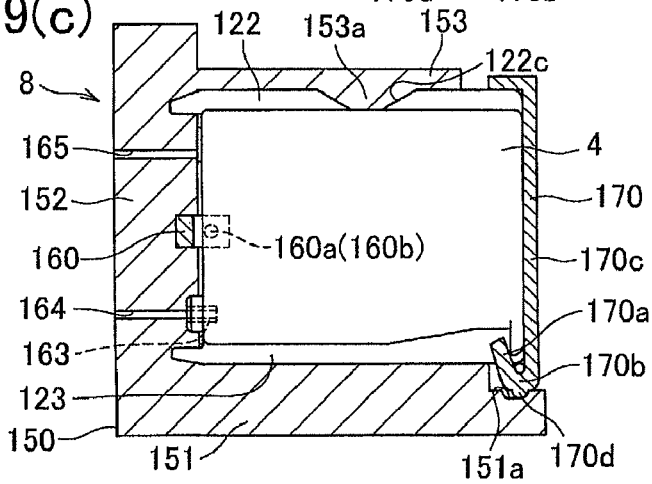

In this state, the operator begins to insert the ink cartridge 4 into the cartridge-accommodating chamber 154 by placing the protruding parts 121*a* and 123*a* of the outer case 21 (leading ends of the respective step parts 121 and 123) in contact with the support part 155 formed on the bottom part 151, as shown in FIG. 9(*a*). Specifically, the ink cartridge 4 is pushed into the cartridge-accommodating chamber 154 in a direction indicated by the arrow E (diagonally downward) so that the step parts 121 and 123 slide along the support part 155.

As shown in FIG. 9(*b*), the ink cartridge 4 is pushed toward the inside of the cartridge-accommodating chamber 154 and the top of the ink cartridge 4 (step parts 120 and 122) pushes the engaging bar 153 upward while the engaging bar 153 elastically deforms. The engaging end part 170*a* of the cover member 170 also becomes engaged with the engaging parts 121*b* and 123*b* on the rear edge of the outer case 21. Accordingly, as the ink cartridge 4 is pressed further inward, the cover member 170 begins to rotate about the pivotal support part 170*b* in a direction for closing the cartridge-accommodating chamber 154 (a direction indicated by the arrow F).

At this time, the fitting rod 167 is inserted into the fitting grooves 120*b* and 122*b* of the outer case 21 (see FIG. 3). Hence, if the operator attempts to mount the ink cartridge 4 in an upside-down orientation (with the ink-outputting unit 31 on the top and the air-introducing unit 32 on the bottom), the fitting rod 167 prevents the ink cartridge 4 from being inserted all the way into the cartridge-accommodating chamber 154. Accordingly, this construction prevents incorrect mounting of the ink cartridge 4 and prevents damage to the ink-outputting unit 31 and the air-introducing unit 32, as well as damage to the photosensor 160 and the ink extraction tube 163.

When the operator rotates the cover member 170 from the state shown in FIG. 9(*b*) in the direction indicated by the arrow F, the protruding part 153*a* of the engaging bar 153 engages in the recessed engaging parts 120*c* and 122*c* of the outer case 21, as shown in FIG. 9(*c*), thereby preventing the ink cartridge 4 from moving relative to the cartridge-mounting unit 8. Further, the protruding part 170*d* of the cover member 170 engages in the recessed part 151*a* of the bottom part 151, preventing the cover member 170 from rotating relative to the bottom part 151. Hence, the cover member 170 reliably locks the ink cartridge 4 so that the ink cartridge 4 cannot pop out of the cartridge-accommodating chamber 154, and maintains the ink cartridge 4 in a locked state. With this construction, when the ink cartridge 4 is mounted in the cartridge-mounting unit 8, the ink cartridge 4 cannot easily come out of the cartridge-mounting unit 8, even when external forces due to vibrations during printing and the like act on the ink cartridge 4.

The front surface of the ink cartridge 4 contacts the mounting surface 156 of the inner wall part 152 at the same time the ink cartridge 4 is immovably locked by the inner wall part 152 and the cover member 170. At this time, the ink extraction tube 163 on the mounting surface 156 is inserted into the feed joint 77 of the ink-outputting unit 31, pushing the feed valve 78 rearward and opening the ink-outputting channel 70. Consequently, ink in the ink chamber 40 is introduced through the ink-outputting channel 70 and supplied to the inkjet head 5 via the ink extraction tube 163 and the ink channel 164 of the cartridge-mounting unit 8. Simultaneously, the protruding part 98*a* of the air valve 98 in the air-introducing unit 32 contacts the mounting surface 156. By this contact, the air valve 98 is pushed rearward and the air-introducing channel 90 is opened. Consequently, air is introduced from the air communication channel 165 of the cartridge-mounting unit 8 into the ink chamber 40 via the air-introducing channel 90.

Simultaneously, the light-emitting element 160*a* and the light-receiving element 160*b* of the photosensor 160 are inserted into the through-hole (configured of the notch parts 114 and 115; see FIG. 3) in the front surface of the outer case 21. At this time, the light-shielding member 60 passes between the light-emitting element 160*a* and the light-receiving element 160*b*. Consequently, the light-shielding parts 65 and 66 provided on the light-shielding member 60 and having different dimensions in the front-to-rear direction (the mounting direction and ink-outputting direction) interrupt light emitted from the light-emitting element 160*a* (turning the photosensor 160 on) for specific time intervals. Thus, the photosensor 160 outputs two waveforms having different wavelengths to the control unit 3.

Once the ink cartridge 4 is completely mounted, as shown in FIG. 9(*c*), the light-emitting element 160*a* and the light-receiving element 160*b* oppose each other across the bottom end of the detection part 50 provided in the ink-accommodating member 30. When the ink chamber 40 has sufficient residual ink, the light-shielding plate 52 on the sensor arm 51 is positioned in the lower region of the detection part 50. Therefore, the light-shielding plate 52 blocks light emitted from the light-emitting element 160*a*, turning the photosensor 160 on. On the other hand, when the ink chamber 40 does not have sufficient residual ink, the light-shielding plate 52 is not positioned in the lower region of the detection part 50. Therefore, light emitted from the light-emitting element 160*a* is not blocked by the light-shielding plate 52 but is received by the light-receiving element 160*b*, turning the photosensor 160 off.

Conversely, when removing the ink cartridge 4 from the cartridge-mounting unit 8, the user rotates the cover member 170 downward to the open position. This causes the protruding part 170*d* of the cover member 170 to come out of the recessed part 151*a* of the bottom part 151, releasing the locked state on the ink cartridge 4.

The ink cartridge 4 has been mounted against the urging forces of the first and second feed springs 79 and 81 acting in a direction for closing the ink-outputting channel 70 and against the urging forces of the first and second air springs 99 and 101 acting in a direction for closing the air-introducing channel 90. Therefore, the urging forces of these springs constantly act on the mounted ink cartridge 4 in a direction for ejecting the ink cartridge 4 from the cartridge-accommodating chamber 154.

Accordingly, when the locked state of the ink cartridge 4 in the cover member 170 is released, the ink cartridge 4 is pushed from the cartridge-accommodating chamber 154 and ejected outward. At this time, the protruding part 153*a* of the engaging bar 153 is disengaged from the recessed engaging parts 120*c* and 122*c* of the outer case 21, placing the ink cartridge 4 in the state shown in FIG. 9(*b*) in which the user can grip and remove the ink cartridge 4.

As the ink cartridge 4 is removed, the light-emitting element 160*a* and the light-receiving element 160*b* of the photosensor 160 are extracted from the through-hole formed in the front surface of the outer case 21. At this time, the light-shielding member 60 passes between the light-emitting element 160*a* and the light-receiving element 160*b*, and the light-shielding parts 65 and 66 provided on the light-shielding member 60 momentarily block light emitted from the light-emitting element 160*a*, similarly to the case where mounting the ink cartridge 4. Consequently, the photosensor 160 outputs a signal formed of two waveforms with different wavelengths to the control unit 3. However, since the dimensions of the light-shielding parts 65 and 66 in the front-to-rear direction are different, the waveform pattern in the signal outputted by the photosensor 160 when the ink cartridge 4 is removed is opposite that when the ink cartridge 4 is mounted.

Figure 10:
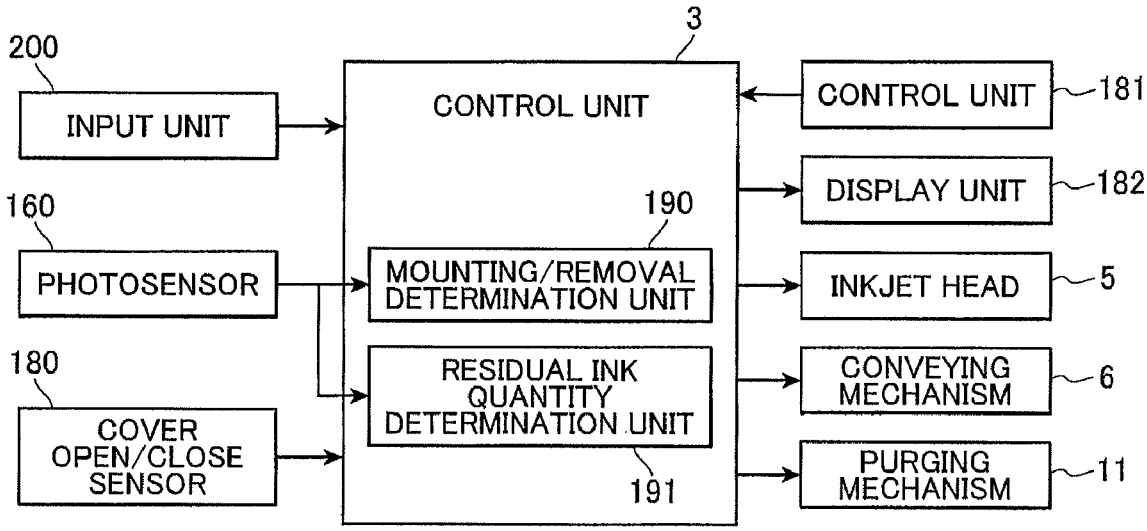
FIG. 10 is a block diagram diagrammatically illustrating a configuration for controlling the inkjet printer.

Next, the electrical structure of the inkjet printer 2 built around the control unit 3 will be described with reference to the block diagram in FIG. 10.

The control unit 3 is provided with a CPU (central processing unit); a ROM (read-only memory) storing various programs, data, and the like for controlling the overall operations of the inkjet printer 2; a RAM (random access memory) temporarily storing data and the like being processed by the CPU; an input/output interface; and the like. An input unit 200 of a personal computer or the like inputs print data and other data into the control unit 3. The user also operates a control unit 181 on the inkjet printer 2 for inputting various commands. The control unit 3 also receives output signals inputted from the photosensor 160 provided on each cartridge-mounting unit 8 in the holder 7, and signals related to the open/closed state of the cover 140 (see FIG. 7) inputted from the cover open/close sensor 180. The control unit 3 controls the operations of each component in the inkjet printer 2, including the inkjet head 5 and the conveying mechanism 6, based on this input data.

When the input unit 200 inputs print data, for example, the control unit 3 controls the conveying mechanism 6 to convey the recording paper P in the paper-conveying direction shown in FIG. 1. Further, the control unit 3 controls movement of the carriage 9 together with the inkjet head 5 and controls the inkjet head 5 to eject ink droplets from the plurality of nozzles onto the recording paper P. Accordingly, text, images, and the like corresponding to the print data on the recording paper P are recorded. The control unit 3 also displays messages on a display unit 182 to notify the user of a situation of the inkjet recording system 1 when a problem occurs during a recording operation on the recording paper P, for example, when an ink cartridges 4 is not mounted in one of the cartridge-mounting units 8. The control unit 3 also controls the purging mechanism 11 to purge the nozzles formed in the inkjet head 5 when the user inputs a purge command on the control unit 181 or when an ink cartridge 4 has been replaced and it is necessary to discharge air that has entered the inkjet head 5 and high-viscous ink.

The control unit 3 also has a mounting/removal determination unit 190, and a residual ink quantity determination unit 191. When the ink cartridge 4 is mounted or removed, the mounting/removal determination unit 190 determines from a signal outputted from the photosensor 160 whether the operation has been a mounting or removal operation. The residual ink quantity determination unit 191 determines the presence of residual ink in the ink cartridge 4 from a signal outputted by the photosensor 160 when the ink cartridge 4 is mounted. Hence, based on an output signal from a single photosensor 160 provided on the cartridge-mounting unit 8, the control unit 3 can detect whether the ink cartridge 4 has been mounted or removed. Further, based on an output signal from a single photosensor 160, the control unit 3 can detect the presence of ink in the ink cartridge 4 when the ink cartridge 4 is in a mounted state.

Next, the processes for determining mounting and removal of the ink cartridge 4 with the mounting/removal determination unit 190 and for determining the existence of residual ink with the residual ink quantity determination unit 191 will be described in detail with reference to FIGS. 11-14. In each of FIGS. 11-14, "(a)" conceptually illustrates the positional relationships among the light-shielding parts 65 and 66 of the light-shielding member 60, the light-shielding plate 52 of the sensor arm 51, and the light-emitting element 160*a* (and light-receiving element 160*b*) of the photosensor 160, while "(b)" shows the signal waveform outputted from the photosensor 160 based on the condition in (a).

[When Mounting the Ink Cartridge 4]

Figure 11A:
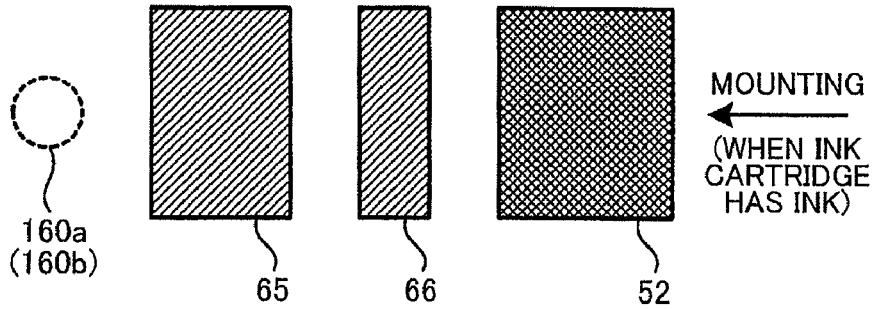
FIG. 11(*a*) diagrammatically shows a positional relation ship of two light-shielding parts of a light-shielding member and a photosensor of a sensor arm for illustrating a blocking operation of the light shielding member and the sensor arm when the ink cartridge having residual ink is mounted.
Figure 11B:
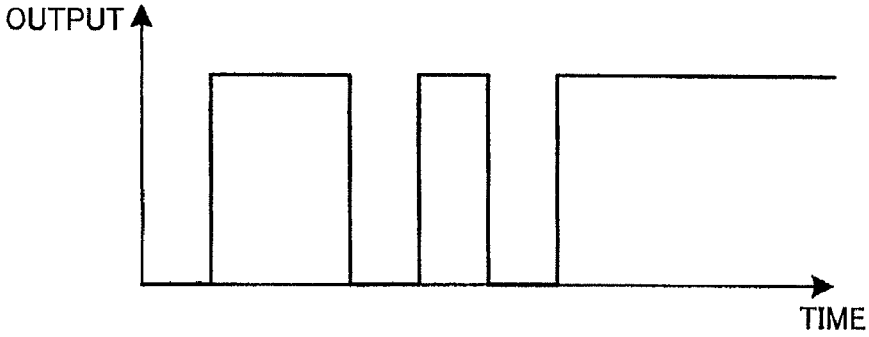

As shown in FIG. 11(*a*), when an ink cartridge 4 has sufficient residual ink, the light-shielding plate 52 of the sensor arm 51 is aligned with the light-shielding parts 65 and 66 of the light-shielding member 60 in the front-to-rear direction (mounting direction). When the ink cartridge 4 is mounted in this state, the light-shielding member 60 passes between the light-emitting element 160*a* and the light-receiving element 160*b* positioned on the front side of the ink cartridge 4. While the light-shielding member 60 passes the light-emitting element 160*a* and the light-receiving element 160*b*, the front light-shielding part 65 and the rear light-shielding part 66 sequentially interrupt light emitted from the light-emitting element 160*a*.

The dimensions of the light-shielding parts 65 and 66 in the front-to-rear direction (mounting direction) differ from each other, that is, the dimension of the front (downstream side in the mounting direction) light-shielding part 65 is greater than the dimension of the rear (upstream side in the mounting direction) light-shielding part 66. Thus, the length of time that the longer front light-shielding part 65 interrupts the light while passing between the light-emitting element 160*a* and the light-receiving element 160*b* is generally longer than the length of time that the shorter rear light-shielding part 66 interrupts light while passing between the light-emitting element 160*a* and light-receiving element 160*b*. Therefore, as shown in FIG. 11(*b*), two waveforms having a long wavelength and a short wavelength in sequence appears in the signal outputted from the photosensor 160, indicating when light from the light-emitting element 160*a* has been interrupted and the photosensor 160 has been turned on (high output).

After the light-shielding parts 65 and 66 pass between the light-emitting element 160*a* and the light-receiving element 160*b* and mounting of the ink cartridge 4 is complete, the light-shielding plate 52 of the sensor arm 51 continuously blocks light emitted from the light-emitting element 160*a*. Accordingly, output from the photosensor 160 changes from OFF (low output) to ON (high output) and remains in the ON state thereafter.

Figure 12A:
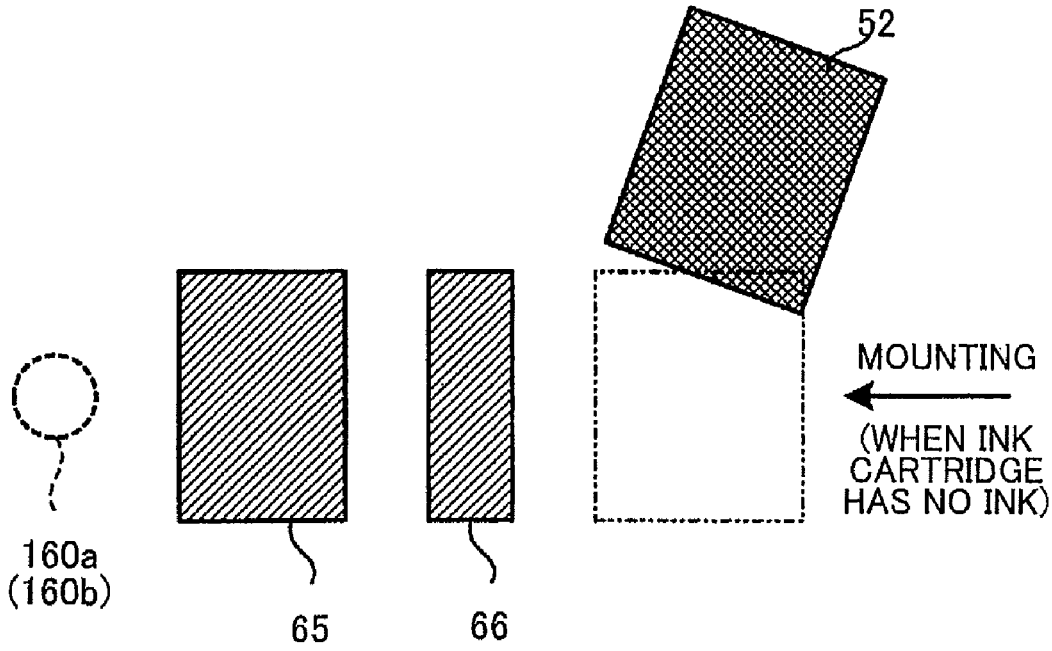
FIG. 12(*a*) diagrammatically shows a positional relation ship of the two light-shielding parts of the light-shielding member and the photosensor of the sensor arm for illustrating the blocking operation of the light shielding member and the sensor arm when the ink cartridge having no ink is mounted.
Figure 12B:
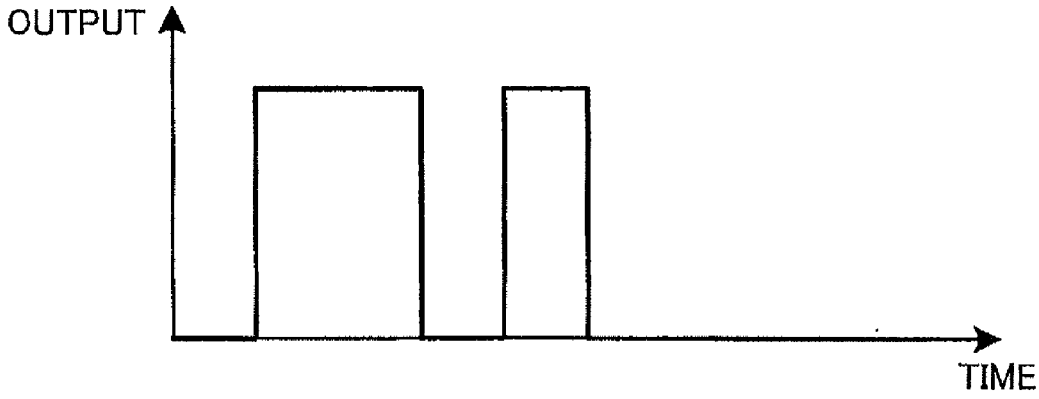

On the other hand, in the case where an ink cartridge 4 is empty with no residual ink as shown in FIG. 12(*a*), the light-shielding plate 52 of the sensor arm 51 is shifted above the original position aligned with the light-shielding parts 65 and 66 (indicated by a broken line with alternating dashes and double-dots). In this case, as shown in FIG. 12(*b*) similarly to the example of FIG. 11(*b*), two waveforms appear in the output signal from the photosensor 160. Here, the two waveforms has a long wavelength and a short wavelength, respectively, and produced by the light-shielding parts 65 and 66 interrupting light from the light-emitting element 160*a*. However, after the light-shielding parts 65 and 66 pass between the light-emitting element 160*a* and the light-receiving element 160*b* and mounting of the ink cartridge 4 is complete, the light-shielding plate 52 is not positioned to block light emitted from the light-emitting element 160*a* and, thus, the photosensor 160 remains in the OFF state.

[When Removing the Ink Cartridge 4]

Figure 13A:
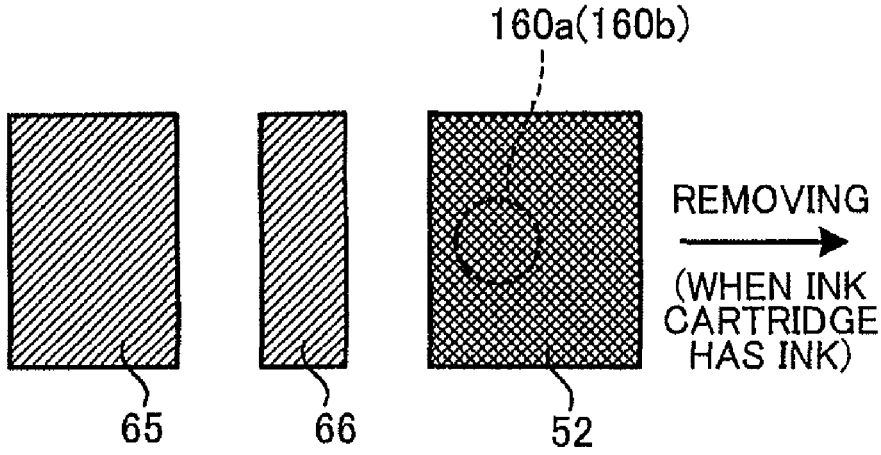
FIG. 13(*a*) diagrammatically shows a positional relation ship of the two light-shielding parts of the light-shielding member and the photosensor of the sensor arm for illustrating the blocking operation of the light shielding member and the sensor arm when the ink cartridge having residual ink is removed.
Figure 13B:
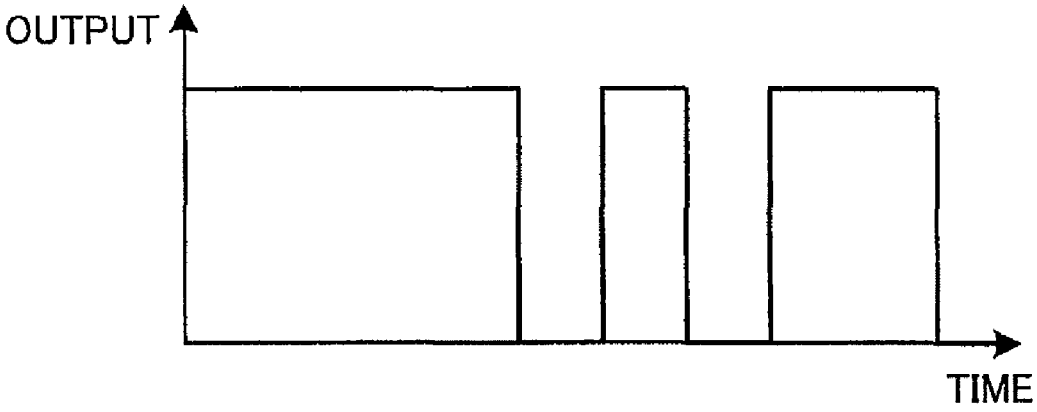

As shown in FIG. 13(*a*), when an ink cartridge 4 having sufficient residual ink is removed from the cartridge-mounting unit 8, the light-shielding plate 52 of the sensor arm 51 blocking light emitted from the light-emitting element 160*a* moves rearward until the light is no longer blocked. Thus, the photosensor 160 changes from an ON state (high output) to an OFF state (low output). Subsequently, the light-shielding parts 65 and 66 of the light-shielding member 60 pass between the light-emitting element 160*a* and the light-receiving element 160*b*. During this period, the photosensor 160 momentarily turns on, since the light emitted from the light-emitting element 160*a* is interrupted in the order of the rear light-shielding part 66 and the front light-shielding part 65. Accordingly, as shown in FIG. 13(*b*), two waveforms with different wavelengths appear in the output signal from the photosensor 160 in the order of a short wavelength and a long wavelength.

Figure 14A:
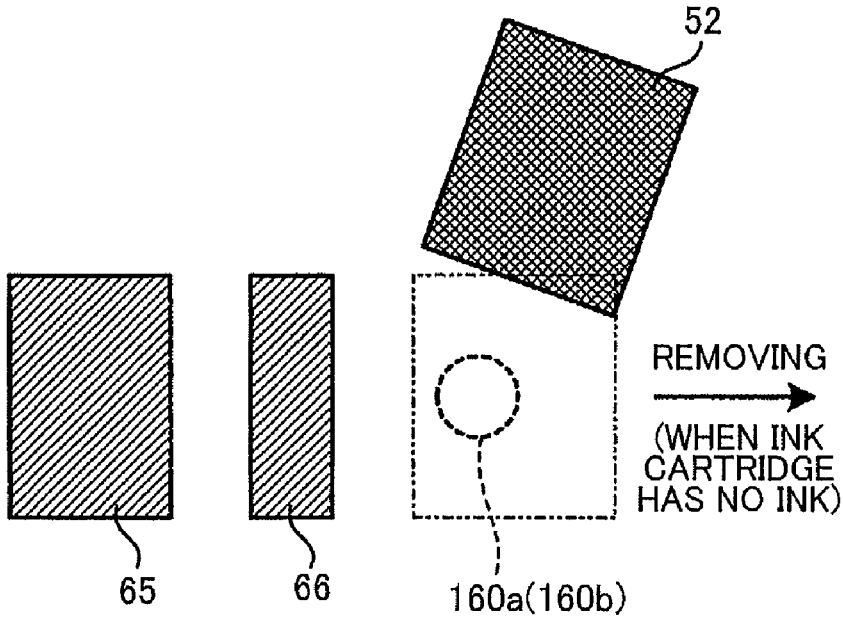
FIG. 14(*a*) diagrammatically shows a positional relation ship of the two light-shielding parts of the light-shielding member and the photosensor of the sensor arm for illustrating the blocking operation of the light shielding member and the sensor arm when the ink cartridge having no ink is removed.
Figure 14B:
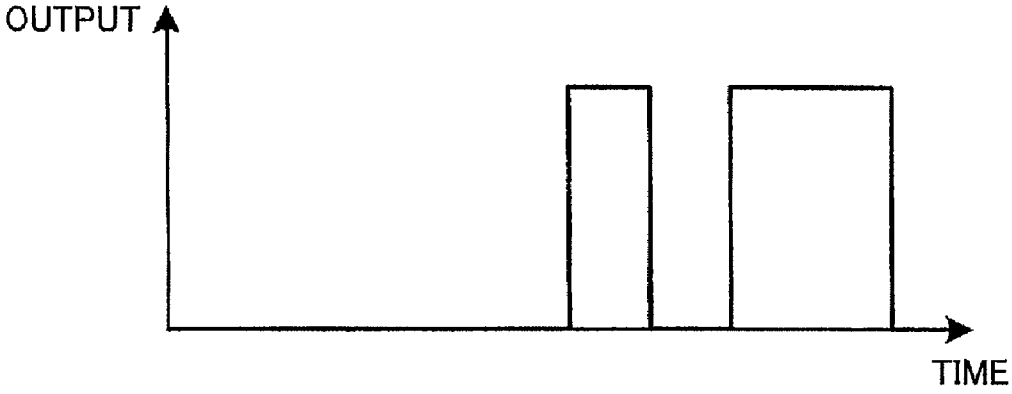

On the other hand, in the example of FIG. 14(*a*), when in an ink cartridge 4 is empty (the ink cartridge has no residual ink), the light-shielding plate 52 of the sensor arm 51 is shifted above the original position aligned with the light-shielding parts 65 and 66 (indicated by a broken line with alternating dashes and double-dots). Accordingly, the photosensor 160 remains off until the light-shielding parts 65 and 66 pass between the light-emitting element 160*a* and the light-receiving element 160*b*. At this time, similarly to the example of FIG. 13(*b*), the two waveforms appear in the order of a short wavelength and a long wavelength that are generated while the light-shielding parts 65 and 66 passing the photosensor 160.

As described above, the waveforms of the signal outputted from the photosensor 160 (the sequence of two waveforms appearing in the output signal with respective long and short wavelengths) differ between mounting and removal of the ink cartridge 4. The mounting/removal determination unit 190 compares the two waveforms appearing in the output signal from the photosensor 160 caused by the light-shielding parts 65 and 66 interrupting light from the light-emitting element 160*a*. When the waveforms appear in the order of long wavelength and short wavelength, the mounting/removal determination unit 190 determines that the ink cartridge 4 has been mounted in the cartridge-mounting unit 8. When the waveforms appear in the order of short wavelength and long wavelength, the mounting/removal determination unit 190 determines that the ink cartridge 4 has been removed from the cartridge-mounting unit 8.

Further, when output from the photosensor 160 is ON in the state where the ink cartridge 4 is mounted, the residual ink quantity determination unit 191 determines that sufficient ink remains in the ink cartridge 4. However, if the output is OFF in the state where the ink cartridge 4 is mounted, the residual ink quantity determination unit 191 determines that the ink cartridge 4 is empty.

The above description assumes that the velocity of the ink cartridge 4 in the front-to-rear direction during mounting or removal (velocity of the light-shielding parts 65 and 66 passing between the light-emitting element 160*a* and the light-receiving element 160*b*) does not fluctuate greatly. Thus, the long and short light-shielding parts 65 and 66 directly translate to long and short interruption times. Accordingly, long and short wavelengths appear in the output signal. However, it is assumed that the velocity of the ink cartridge 4 varies considerably during mounting or removal due to any of numerous factors related to the structures of the ink cartridge 4 and the cartridge-mounting unit 8, the mounting configuration, and the like. If great changes in velocity occur, it is assumed that the interruption time (output wavelength) of the long light-shielding part 65 positioned on the front side could be shorter than the interruption time of the short light-shielding part 66 positioned on the rear side. In this case, the mounting/removal determination unit 190 may confuse the mounting and removal operations. As described below, the control unit 3 according to the embodiment has been configured to consider changes in the velocity of the ink cartridge 4 to accurately determine whether the ink cartridge 4 has been mounted or removed.

(1) The longer front light-shielding part 65 is in the embodiment preferably made sufficiently longer than the shorter rear light-shielding part 66 in order that the waveform outputted due to light-interruption by the front light-shielding part 65 is always longer than the waveform outputted due to light-interruption by the rear light-shielding part 66, even when the velocity of the ink cartridge 4 fluctuates. Therefore, in the embodiment, the slit 61*a* and the notched part 61*b* are positioned so that the front-to-rear dimension of the front light-shielding part 65 (L1 in FIG. 5) is at least three times the front-to-rear dimension of the rear light-shielding part 66 (L2 in FIG. 5).

(2) The inkjet printer 2 is preferably configured so that the light-shielding parts 65 and 66 interrupt light emitted from the light-emitting element 160*a* at a time when the velocity of the ink cartridge 4 is most stable. More specifically, as shown in FIG. 7, the ink extraction tube 163 of the cartridge-mounting unit 8 is inserted into the through-hole 77*a* of the feed joint 77 provided in the ink-outputting unit 31. A frictional force is produced between the ink extraction tube 163 and the feed joint 77. This, frictional force tempers slight fluctuations in the force applied during mounting and removal, thereby reducing the effect of such fluctuations on the velocity of the ink cartridge 4 to achieve a more stable velocity.

Hence, in the preferred embodiment, the distance from the front end of the front light-shielding part 65 to the rear end of the rear light-shielding part 66, i.e., the distance from the front end of the light-shielding member 60 to the front end of the notched part 61*b* (distance L3 in FIG. 5) is set less than or equal to a connection stroke St (see FIG. 7) from the point where the ink extraction tube 163 is inserted into the feed joint 77 (the point the ink extraction tube 163 contacts the inner surface of the through-hole 77*a* formed in the feed joint 77) to the point where the ink extraction tube 163 moves the feed valve 78 to the open position. The connection stroke St is specifically the distance from the front end of the innermost peripheral surface of the feed joint 77 to the front end of the feed valve 78 in the closed position. Accordingly, the light-shielding parts 65 and 66 interrupt light emitted from the light-emitting element 160*a* during a period in which the velocity of the ink cartridge 4 is most stable due to the frictional force produced between the ink extraction tube 163 and the feed joint 77. Therefore, the relationship between wavelengths of waveforms produced when the light-shielding parts 65 and 66 block emitted light is never the inverse of the relationship between the lengths of the light-shielding parts 65 and 66. Accordingly, the mounting/removal determination unit 190 is prevented from mistaking mounting and removal of the ink cartridge 4.

(3) As described above, the ink-outputting unit 31 and air-introducing unit 32 of the ink cartridge 4 according to the embodiment have the springs 79, 81, 99, and 101 (urging members) for urging the feed valve 78 and the air valve 98 in a closed direction (see FIG. 7). When mounted, the ink cartridge 4 is pushed into the cartridge-accommodating chamber 154 of the cartridge-mounting unit 8 against the urging forces of the springs 79, 81, 99, and 101 and is maintained in a locked state by the cover member 170 (see FIG. 9). Therefore, when the ink cartridge 4 is released from the locked state maintained by the cover member 170, the ink cartridge 4 is ejected outward from the cartridge-accommodating chamber 154 by the urging forces of the springs, and the feed joint 77 separates from the ink extraction tube 163. Hence, the velocity of the ink cartridge 4 during removal is fast due to the large urging force applied by the springs immediately after the locked state is released. Thereafter, the velocity of the ink cartridge 4 decreases as the urging force lessens.

In order to compensate for these fluctuations in velocity, the front-to-rear dimension of the light-shielding part 65 positioned on the front side (the downstream side in the mounting direction) is made longer than the light-shielding part 66 positioned on the rear side (the upstream side in the mounting direction) in the embodiment. Therefore, in the case removing the ink cartridge 4, the shorter rear light-shielding part 66 interrupts emitted light in the interval while the velocity of the ink cartridge is high, that is, immediately after the locked state by the cover member 170 is released, and the longer front light-shielding part 65 interrupts emitted light when the velocity has decreased. Accordingly, the two waveforms in the signal outputted from the photosensor 160 always appear in the sequence of short wavelength and long wavelength when the ink cartridge 4 is removed.

When mounting the ink cartridge 4, the user pushes the ink cartridge 4 against the urging forces of the springs 79, 81, 99, and 101. Thus, large fluctuations in velocity are unlikely to occur in the ink cartridge 4 at this time, and the velocity is relatively stable. Therefore, the two waveforms in the signal outputted from the photosensor 160 will always appear in the sequence of long wavelength and short wavelength corresponding to the long and short light-shielding parts 65 and 66. As described above, even though the velocity of the ink cartridge 4 changes abruptly during removal due to the urging forces of the springs 79, 81, 99, and 101, the waveform pattern in the output signal from the photosensor 160 (sequence of long and short wavelengths) is always different between mounting and removal operations. Accordingly, incorrect determinations of the mounting and removal processes are prevented.

By providing the control unit 3 with the mounting/removal determination unit 190 and the residual ink quantity determination unit 191, as described above, the control unit 3 can correctly recognize data for both differentiating whether the ink cartridge 4 has been mounted or removed (i.e., the presence of the ink cartridge 4 in the cartridge-mounting unit 8) and the presence of ink in the ink cartridge 4 based on an output signal from a single photosensor 160 provided on the cartridge-mounting unit 8. Hence, since the control unit 3 can correctly display data on the display unit to notify the user of whether the ink cartridges 4 are mounted and whether the mounted ink cartridges 4 have ink. Accordingly, the invention can provide a user-friendly inkjet recording system 1.

Further, by employing only a single photosensor 160 to detect both the presence of the ink cartridge 4 in the cartridge-mounting unit 8 and the presence of ink in the mounted ink cartridge 4, the invention minimizes the number of detecting means, making it possible to reduce the cost of parts used in the inkjet printer 2.

Since the control unit 3 can distinguish between mounting and removal operations of the ink cartridge 4, the inkjet printer 2 of the embodiment can perform a process such as that described below that would be difficult to implement on a conventional inkjet printer 2 incapable of distinguishing between mounting and removal operations on the ink cartridge 4.

<Preliminary Process for Printing>

When the power to the inkjet printer 2 is on but the photosensor 160 is off (light-transmission state), either the ink cartridge 4 is not mounted in the cartridge-mounting unit 8 or an empty ink cartridge 4 is mounted in the cartridge-mounting unit 8. In such a case, the control unit 3 displays a message on the display unit 182 for the user indicating that either an ink cartridge 4 is not mounted or the ink cartridge 4 is empty and prompts the user to either mount or replace the ink cartridge 4.

However, in conventional inkjet printers that are unable to distinguish between mounting and removal of an ink cartridge 4, the control unit of the printer cannot recognize the presence of an ink cartridge in some cases, even if the user mounted or removed the ink cartridge immediately after the power to the printer has been turned on. More specifically, the state of uninterrupted light from the photosensor (OFF state) does not change between the case where the user removes an empty ink cartridge being mounted when the power is turned on and in the case where the user accidentally mounts an empty ink cartridge when the power is turned on. In such cases, the control unit does not notice a change in status, even though the user has performed an operation. Therefore, after prompting the user to perform an operation, the control unit 3 has conventionally had to receive user confirmation indicating that the operation has been actually performed.

However, since the control unit 3 of the embodiment can distinguish between mounting and removal of the ink cartridge 4, the control unit 3 can correctly recognize the presence of the ink cartridge 4 after the user performs an operation to mount or remove the ink cartridge 4. That is, after displaying a message prompting the user to mount or replace the ink cartridge 4, the control unit 3 need not receive user confirmation that the user actually performed the mounting operation. Next, the preliminary process for printing executed by the control unit 3 in the embodiment will be described with reference to the flowchart in FIG. 15. In the flowchart, Si (i=10, 11, . . . ) indicates each step of the process.

Figure 15:
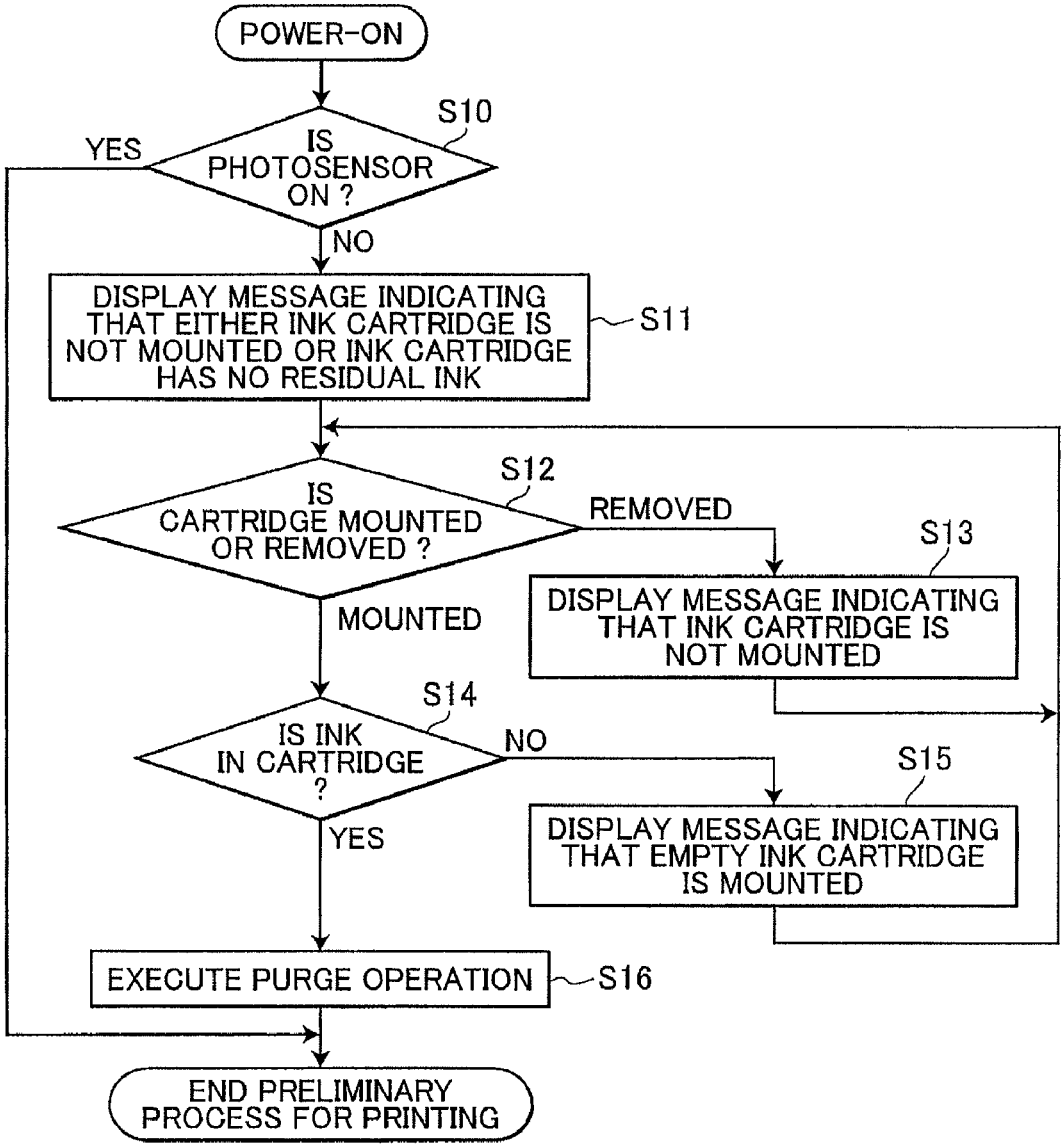
FIG. 15 is a flowchart illustrating a preliminary process for printing.

The control unit 3 executes this process immediately after the power to the inkjet printer 2 is turned on. As shown in FIG. 15, if the output from the photosensor 160 of a cartridge-mounting unit 8 is ON (light-shielded state) immediately after the power has been turned on (S10: YES), then an ink cartridge 4 having sufficient residual ink is mounted in the cartridge-mounting unit 8 and, hence, the inkjet printer 2 is in a state being capable of printing. Therefore, the control unit 3 ends the preliminary process for printing without continuing further.

However, if the photosensor 160 is OFF (light-transmission state) immediately after the power is turned on (S10: NO), then in S11 the control unit 3 displays a message on the display unit 182 indicating that either the ink cartridge 4 is not mounted or the ink cartridge 4 has no residual ink.

When the user views the message and performs an operation on the ink cartridge 4, in S12 the mounting/removal determination unit 190 determines, based on the output signal from the photosensor 160, whether the user operation has been an operation to mount or an operation to remove the ink cartridge 4. If the mounting/removal determination unit 190 determines that the ink cartridge 4 has been removed, in S13 the control unit 3 displays a message on the display unit 182 indicating that an ink cartridge 4 is not mounted and prompts the user to mount the ink cartridge 4.

If the mounting/removal determination unit 190 determines that the ink cartridge 4 has been mounted, in S14 the residual ink quantity determination unit 191 determines whether ink exists in the mounted ink cartridge 4 based on the output signal from the photosensor 160. If the residual ink quantity determination unit 191 determines that no ink exists in the ink cartridge 4 (S14: NO), in S15 the control unit 3 displays a message on the display unit 182 indicating that an empty ink cartridge 4 has been mounted and prompts the user to mount an ink cartridge 4 with residual ink. However, if the residual ink quantity determination unit 191 determines that ink exists in the ink cartridge 4 (S14: YES), in S16 the control unit 3 controls the inkjet head 5 and the purging mechanism 11 to execute a purge operation for introducing ink into the inkjet head 5 and subsequently ends the preliminary process for printing.

In this way, if the photosensor 160 is off when the power to the inkjet printer 2 is turned on, the control unit 3 displays a message prompting the user to perform a mounting operation. Subsequently, the control unit 3 can recognize whether the operation actually performed by the user has been a mounting operation or a removal operation. Hence, the control unit 3 can display correct data on the display unit 182 regarding the mounted state recognized by the control unit 3 without querying the user whether the user actually mounted the ink cartridge 4. Accordingly, the user can simplify the mounting operation of the ink cartridge 4.

<Near-Empty Ink Extraction Process>

Even after ink in the ink cartridge 4 is consumed to the point that the sensor arm 51 rotates and the light-shielding plate 52 no longer blocks light emitted from the photosensor 160 (the photosensor 160 is off), a small amount of ink actually remains in the ink cartridge 4 (hereinafter this state will be referred to as a "near-empty state"). In order to use all this residual ink, printers normally count (using a counter implemented in software) the number of ejections from the nozzles of the inkjet head 5 after the photosensor 160 has turned off and continue printing until the number of ejections reaches a prescribed value.

However, conventional inkjet printers that is unable to differentiate between mounting and removal operations on an ink cartridge cannot recognize when an ink cartridge in a near-empty state is removed since the output from the photosensor does not change. Accordingly, the conventional printer cannot keep track of residual ink in a near-empty ink cartridge. Therefore, if an ink cartridge is determined to be near-empty, the conventional inkjet printer assumes that the ink cartridge has been removed when the user performs a separate operation not directly related to removal of the ink cartridge (for example, when the cover open/close sensor 180 detects that the cover 140 (see FIG. 8) has been opened to expose the cartridge-mounting units 8) and halts printing at this time. However, in this process, residual ink is often left over without being used since printing with a near-empty ink cartridge is ended simply after the cover or the like is operated, regardless of whether the near-empty ink cartridge has been removed.

With the structure of the conventional printer similar to the embodiment, for example, in which a single cover 140 covers all four cartridge-mounting units 8, if two or more ink cartridges 4 have reached the near-empty state and the user opens the cover 140 to replace one of the ink cartridges 4, all of the other ink cartridges 4 in a near-empty state (with some ink remaining) would become unusable.

However, the control unit 3 in the embodiment is capable of recognizing a cartridge removal operation when a near-empty ink cartridge 4 is removed. Accordingly, the control unit 3 need not end printing with a near-empty ink cartridge simply when an operation not directly related to removal (opening the cover 140 or the like) is performed. Hence, the inkjet printer 2 of the embodiment can use all residual ink in an ink cartridge 4 after the ink cartridge 4 has been found to be near-empty.

<Mounting Event Detection Process>

As described above, when mounting the ink cartridge 4, the user pushes the cover member 170 against the urging forces of the springs 79, 81, 99, and 101 in the ink-outputting unit 31 and the air-introducing unit 32 and locks the ink cartridge 4 with the cover member 170 (see FIG. 9). If the cover member 170 is not pushed firmly at this time, the urging forces of the springs 79, 81, 99, and 101 will push the ink cartridge 4 back toward the rear. When the ink cartridge 4 is pushed back in this way, a larger volume of air is allowed to enter the feed joint 77 of the ink-outputting unit 31 and the ink extraction tube 163 than when the ink cartridge 4 is correctly mounted in one motion. Consequently, the suction pump 13 of the purging mechanism 11 must draw out a larger volume of air when the purging mechanism 11 performs a purging operation with the ink cartridge 4 being mounted.

Since an inkjet printer of the conventional configuration cannot differentiate between a mounting and removal operation on an ink cartridge, obviously the inkjet printer cannot also recognize when the ink cartridge is pushed backward during a mounting operation thereof. Consequently, the conventional inkjet printer sets the post-mounting purge amount to the maximum amount required when the ink cartridge 4 is pushed back. Thus, the conventional inkjet printer always performs a purge with the maximum suction amount regardless of whether the push-back occurred. Therefore, the conventional printer performs maximum suction, even when the ink cartridge 4 has been correctly mounted and requires only a small amount of suction. Accordingly, an unnecessary is consumed. However, the inkjet printer 2 according to the embodiment can detect whether push-back occurred during the mounting operation from the waveform outputted by the photosensor 160 when the light-shielding parts 65 and 66 of the light-shielding member 60 block light emitted from the light-emitting element 160*a*.

Figure 16A:
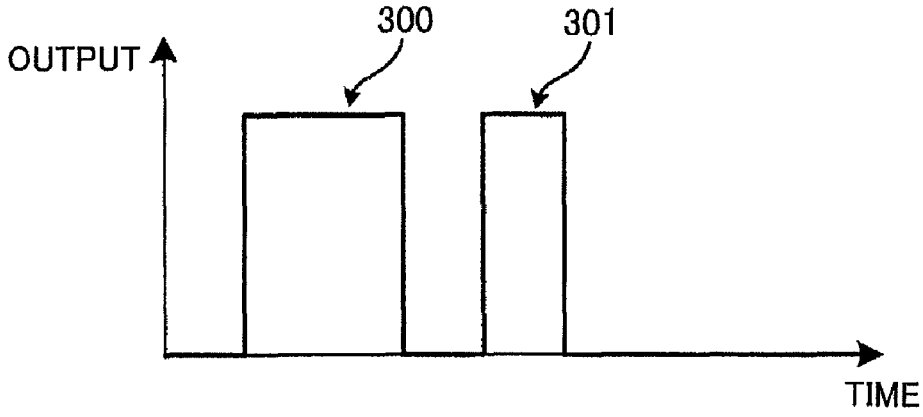
FIG. 16(*a*) shows waveforms outputted from the photosensor when the cartridge is mounted normally.
Figure 16B:
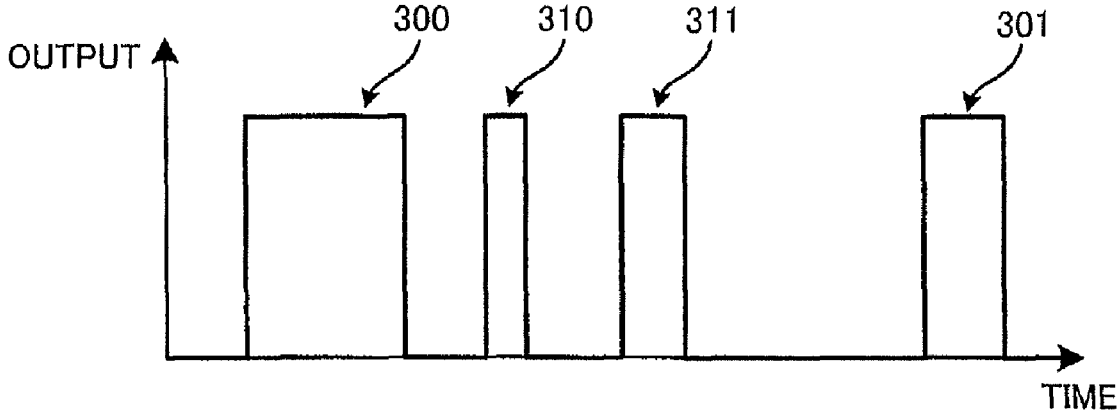

If the ink cartridge 4 is properly mounted without being pushed back during the mounting operation, the light-shielding parts 65 and 66 interrupt light emitted from the light-emitting element 160*a*. By these interruptions, as shown in FIG. 16(*a*), the photosensor 160 produces the output signal having only two waveforms 300 and 301. However, if the ink cartridge 4 is pushed back during the mounting operation thereof, the light-shielding parts 65 and 66 interrupt light as the ink cartridge 4 is pushed backward. By these interruptions as the ink cartridge is pushed backward, as shown in FIG. 16(*b*), superfluous waveforms (two center waveforms 310 and 311 in FIG. 16(*b*)) appear in the output signal, in addition to the waveforms 300 and 301 produced in a normal operation. Here, the waveform produced when the light-shielding plate 52 of the sensor arm 51 blocks light after the ink cartridge 4 has been mounted is abbreviated in FIGS. 16(*a*) and 16(*b*).

In other words, the number of waveforms appearing in the output signal differs between a proper mounting operation during which the ink cartridge 4 is not pushed back and an improper mounting operation during which the ink cartridge 4 is pushed back. It is also possible to determine whether the user-operation has been a mounting operation or a removal operation by comparing the lengths of the initial waveform 300 and the final waveform 301 among the waveforms produced in the output signal. Hence, the control unit 3 can discern events in the process for mounting the ink cartridge 4 (whether the ink cartridge 4 has been pushed back) and can modify the purge amount based on these events.

Figure 17:
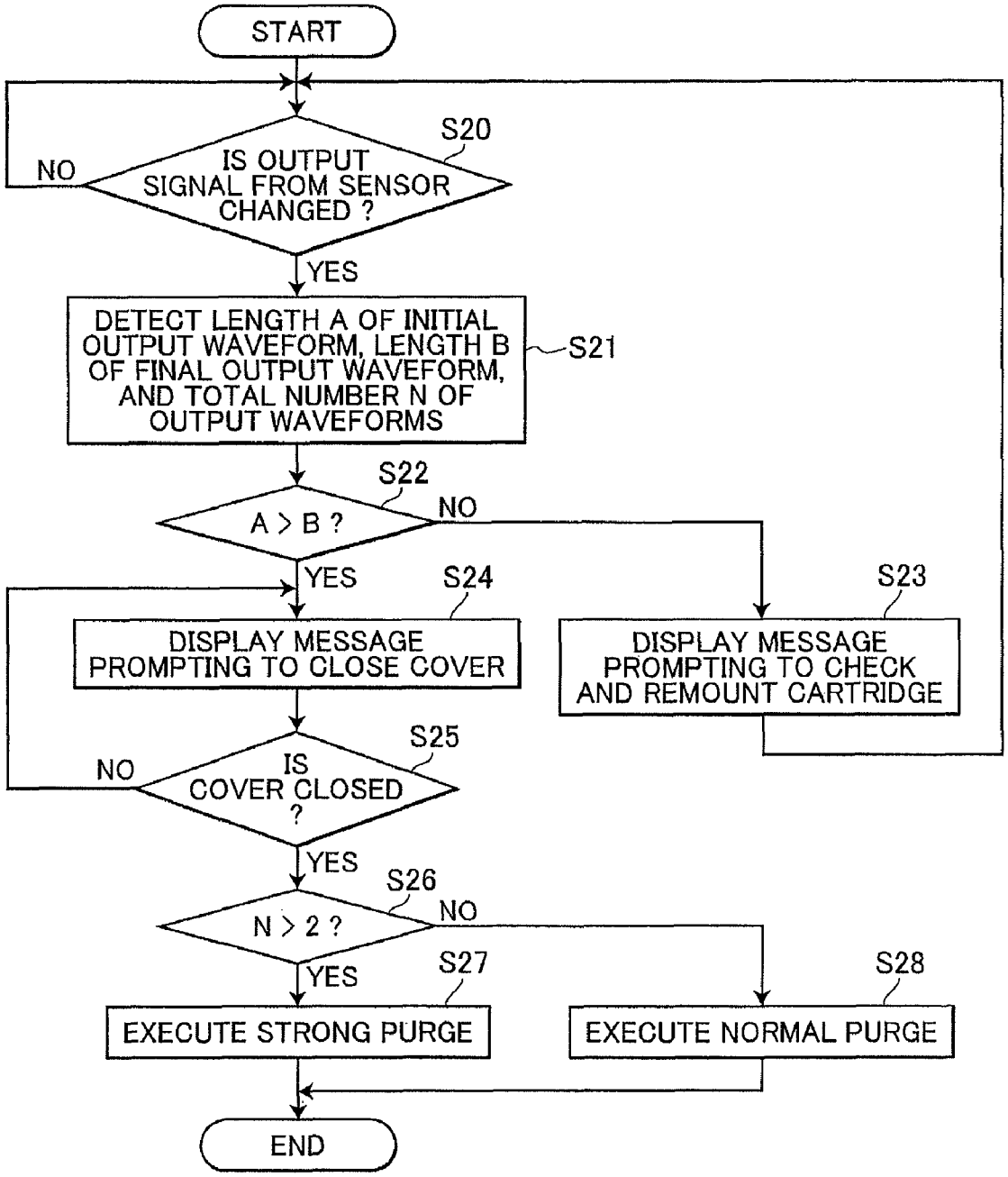
FIG. 17 is a flowchart illustrating a detection process of mounting events.

Next, a process including detection of mounting events described above will be described in detail with reference to the flowchart in FIG. 17. The control unit 3 executes this process when the cover open/close sensor 180 detects that the cover 140 (see FIG. 8) is in the open state and when the ink cartridge 4 is not mounted in the cartridge-mounting unit 8.

First, when the output signal from the photosensor 160 originally in the OFF state changes due to the user mounting the ink cartridge 4 (S20: YES), in S21 the control unit 3 detects a total number N of output waveforms appearing in the output signal, a length A of the initial output waveform, and a length B of the final output waveform.

The mounting/removal determination unit 190 compares the length A of the initial output waveform and the length B of the final output waveform. If A is less than or equal to B (S22: NO), the mounting/removal determination unit 190 determines that the ink cartridge 4 is not mounted in the cartridge-mounting unit 8. Therefore, in S23 the control unit 3 displays a message on the display unit 182 prompting the user to check and remount the ink cartridge 4, and subsequently returns to S20.

However, if A is greater than B (S22: YES), the mounting/removal determination unit 190 determines that the ink cartridge 4 is mounted in the cartridge-mounting unit 8. Thus, in S24 the control unit 3 displays a message on the display unit 182 prompting the user to close the cover 140. After the cover open/close sensor 180 detects that the cover 140 has been closed (S25: YES), the control unit 3 selects a purge mode based on the total number N of waveforms appearing in the output signal.

More specifically, if the total number N of waveforms is greater than the number of light-shielding parts provided on the light-shielding member 60 (two in the embodiment; S26: YES), the control unit 3 determines that push-back of the ink cartridge 4 occurred during the mounting operation thereof and in S27 controls the purging mechanism 11 (see FIG. 1) to execute a strong purge with a greater suction amount. However, if the total number N of waveforms is equivalent to the number of light-shielding parts (two in the embodiment; S26: NO), the control unit 3 determines that the ink cartridge 4 has not been pushed back during the mounting operation thereof and in S28 controls the purging mechanism 11 to execute a normal purge with a smaller suction amount than that used in a strong purge.

Since the control unit 3 can determine whether the ink cartridge 4 has been mounted properly or not, the control unit 3 can select the strong purge with a large suction amount when the ink cartridge 4 has been mounted improperly. Accordingly, the inkjet printer 2 can reliably exhaust a large amount of air, from the inkjet head 5, that has been introduced during the mounting operation of the ink cartridge 4. The control unit 3 can also select a normal purge having a smaller suction amount when the ink cartridge 4 is mounted properly, thereby avoiding the unnecessary consumption of ink.

Experimental Example

Figure 18:
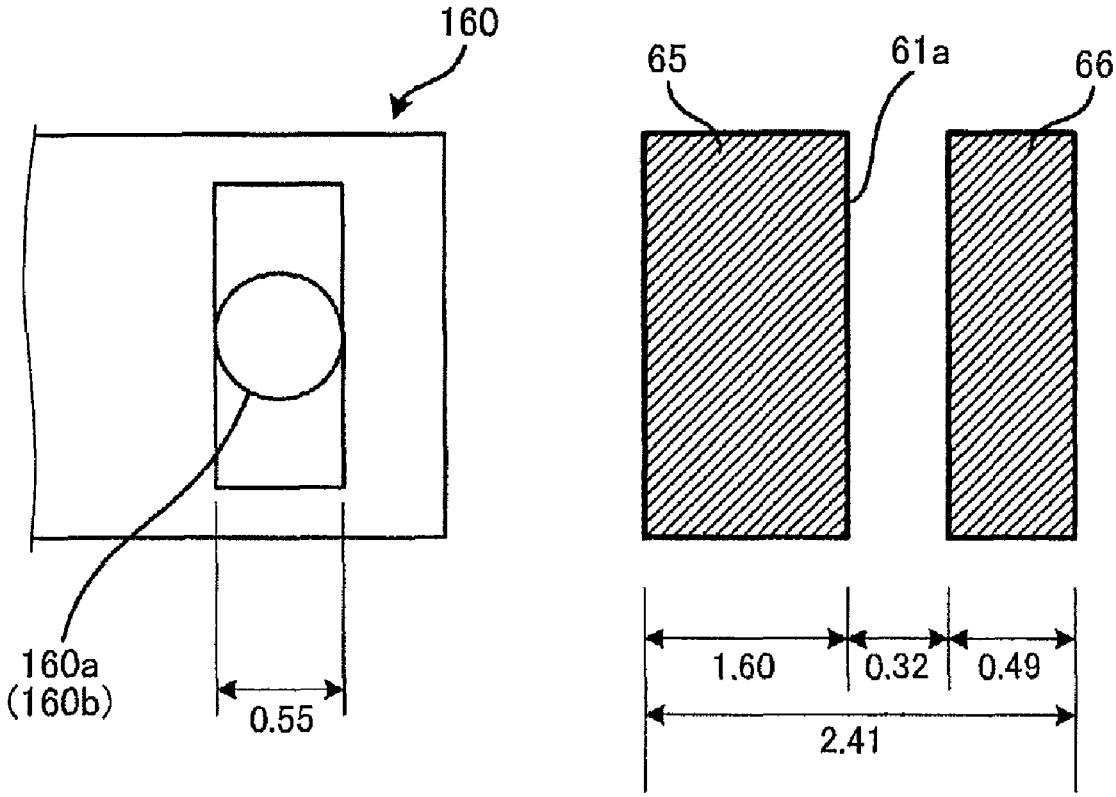
FIG. 18 shows dimensions of the light-shielding member and the photosensor that are used in mounting and removal experiments.

Experiments to mount and remove ink cartridges were performed using light-shielding members with specific dimensions to verify that the above operations could be achieved. FIG. 18 shows dimensions (in the front-to-rear direction) of the light-shielding parts 65 and 66 on the light-shielding member 60 and the slit width (range of light-received in the front-to-rear direction) in the light-receiving element 160*b* of the photosensor 160 used in the mounting and removal experiments. Values are all expressed in units of millimeters (mm).

As shown in FIG. 18, the front-to-rear dimension of the front light-shielding part 65 is 1.60 mm, the width of the slit 61*a* is 0.32 mm, and the front-to-rear dimension of the rear light-shielding part 66 is 0.49 mm. Hence, the front light-shielding part 65 is three times longer than the rear light-shielding part 66 in the front-to-rear direction. Based on the above dimensions for the light-shielding parts 65 and 66 and the slit 61*a*, the distance from the front end of the front light-shielding part 65 to the rear end of the rear light-shielding part 66 is 2.41 mm. Furthermore, the width of the light-receiving slit in the photosensor 160 is 0.55 mm.

Although not indicated in FIG. 18, the connection stroke St of the ink extraction tube 163 shown in FIG. 7 is 2.9 mm. Hence, the distance from the front end of the front light-shielding part 65 to the rear end of the rear light-shielding part 66 (2.41 mm) is smaller than the connection stroke St (2.9 mm). Therefore, the light-shielding parts 65 and 66 are passing between the light-emitting element 160*a* and the light-receiving element 160*b* of the photosensor 160, interrupting light emitted from the light-emitting element 160*a*, while the ink extraction tube 163 is connected to the ink-outputting unit 31.

Figure 19:
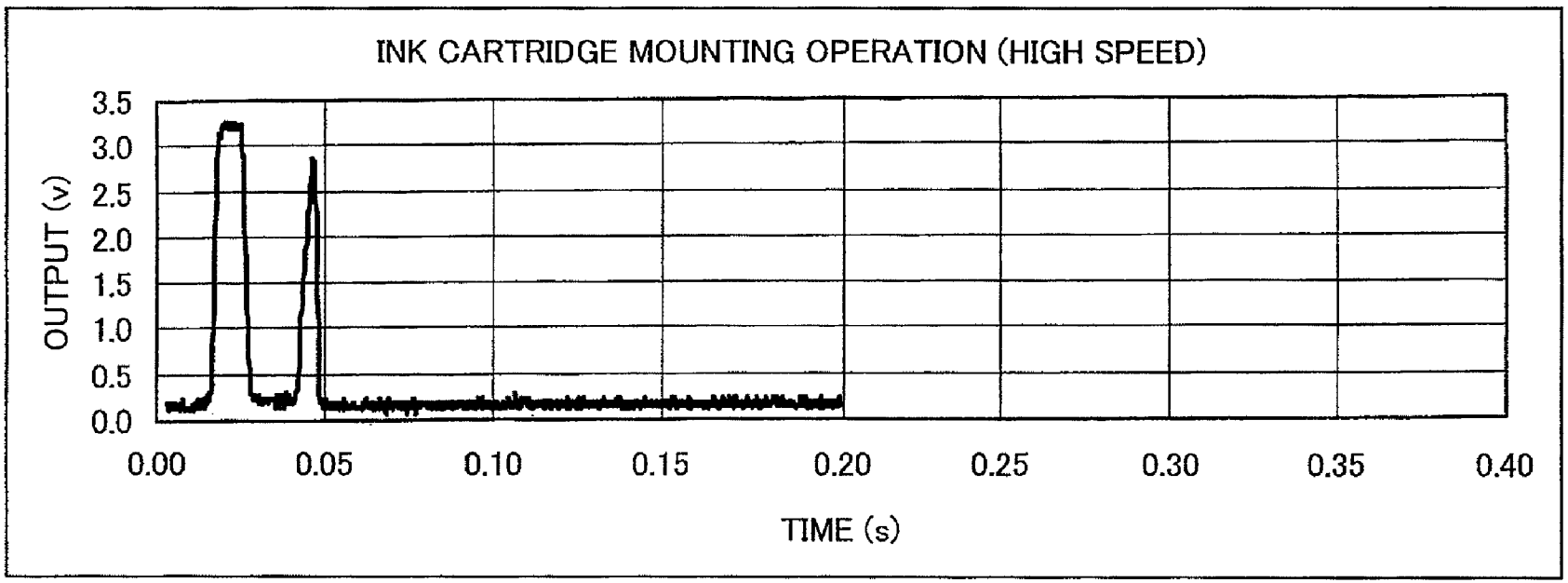
FIG. 19 shows waveforms outputted from the photosensor when the ink cartridge is mounted at high speed.
Figure 20:
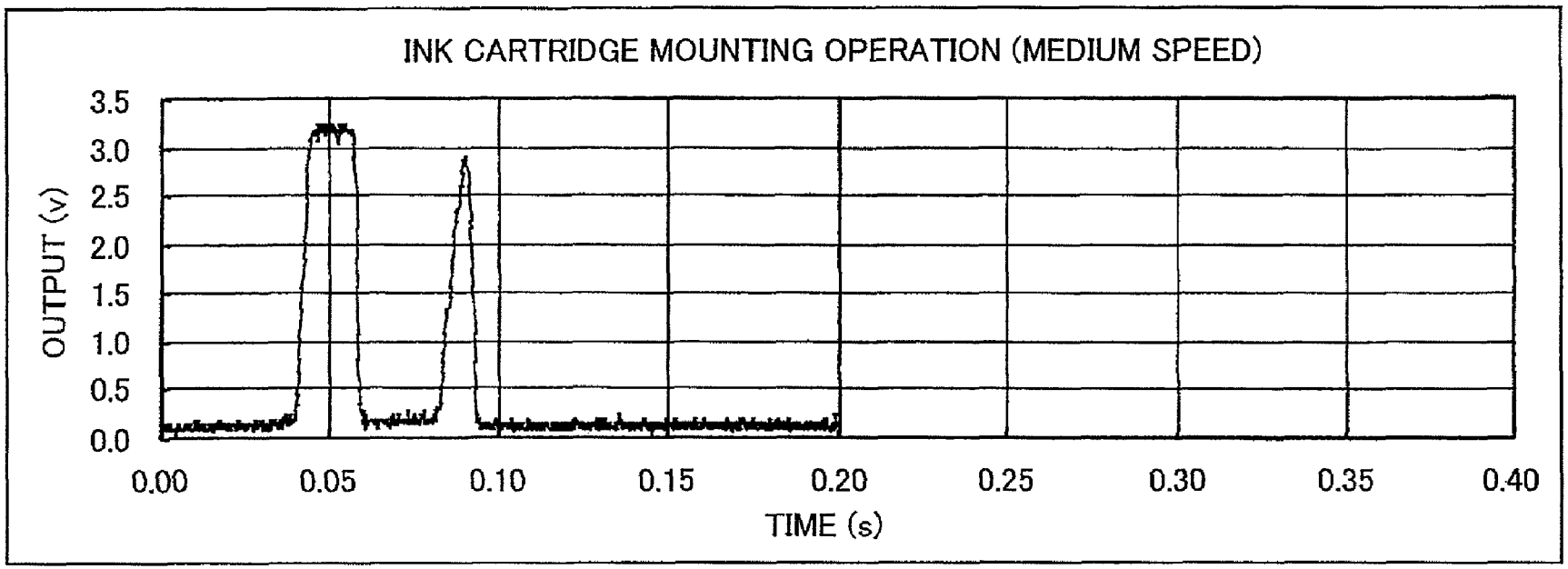
FIG. 20 shows waveforms outputted from the photosensor when the ink cartridge is mounted at medium speed.
Figure 21:
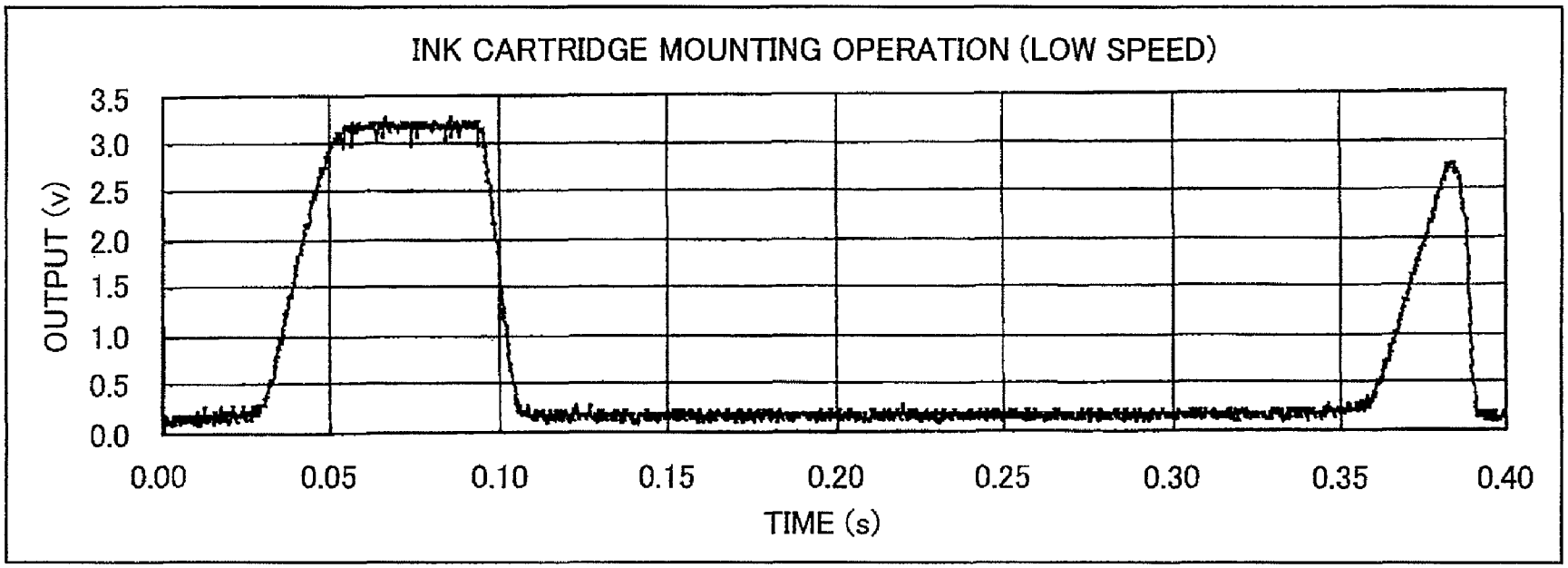
FIG. 21 shows waveforms outputted from the photosensor when the ink cartridge is mounted at low speed.
Figure 22:
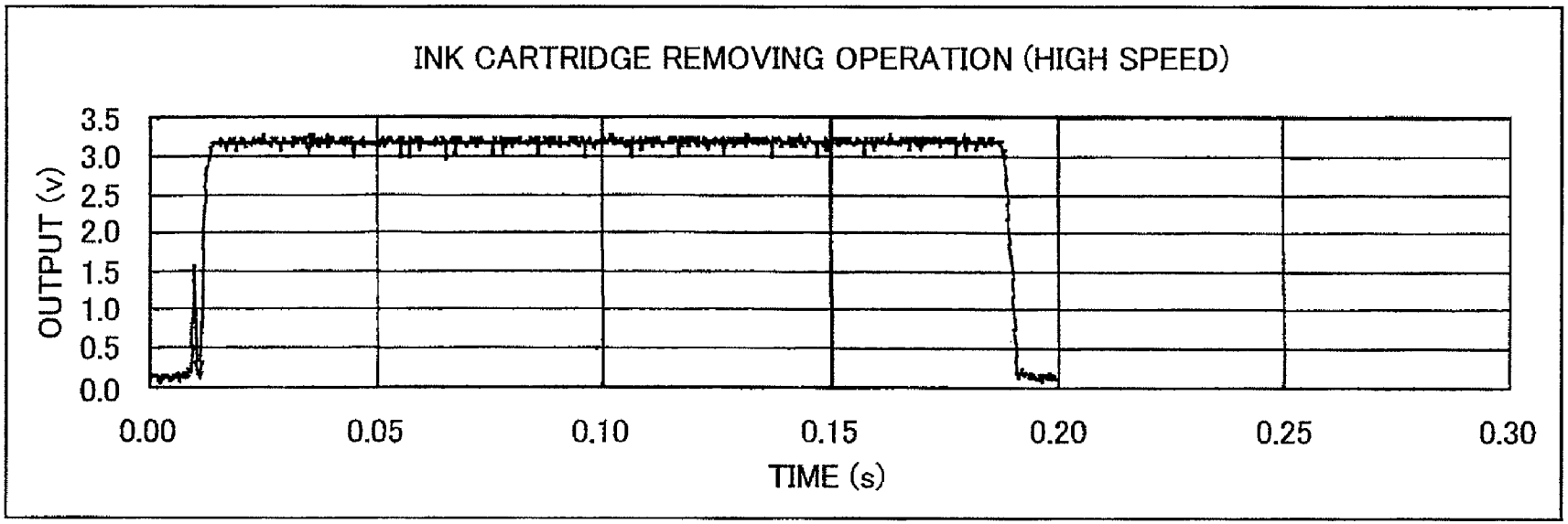
FIG. 22 shows waveforms outputted from the photosensor when the ink cartridge is removed at high speed.
Figure 23:
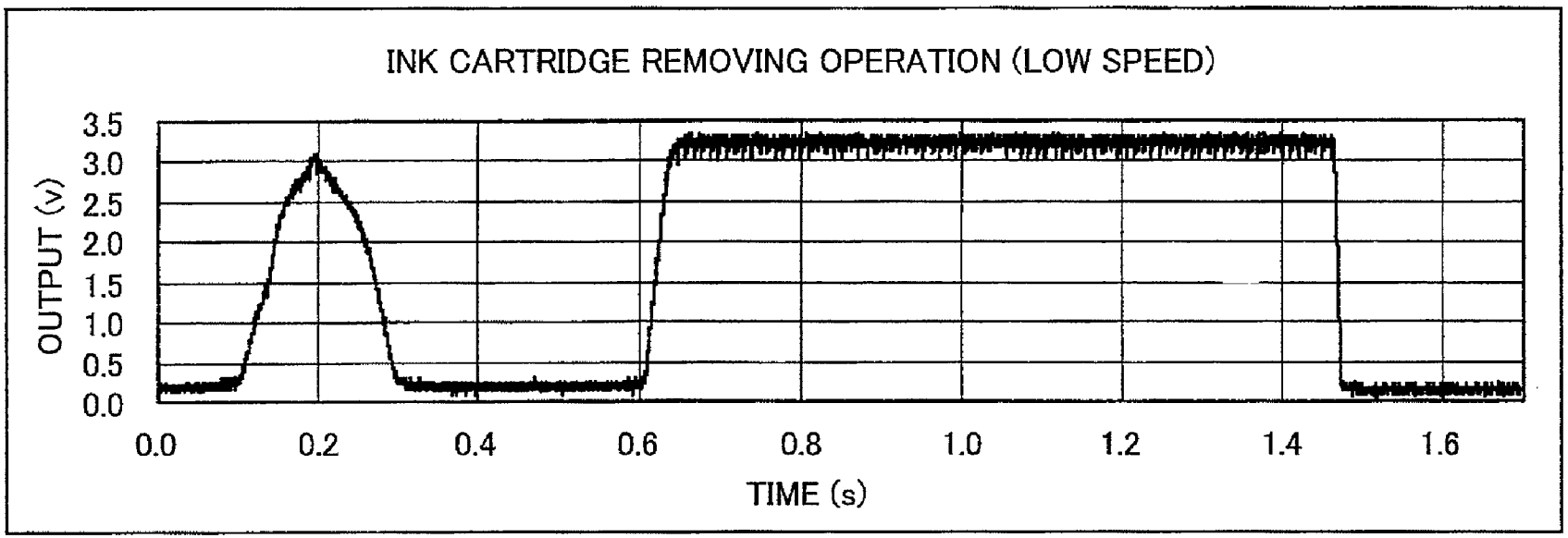
FIG. 23 shows waveforms outputted from the photosensor when the ink cartridge is removed at low speed.

FIGS. 19-21 show the output waveforms from the photosensor 160 when the ink cartridge 4 provided with the light-shielding member 60 described above is mounted in the cartridge-mounting unit 8 at one of three velocities. FIGS. 22 and 23 show the output waveforms from the photosensor 160 when the ink cartridge 4 is removed from the cartridge-mounting unit 8 at one of two velocities.

As shown in FIGS. 19-21, during the mounting operation of the ink cartridge 4, the lengths of the two waveforms produced when the light-shielding parts 65 and 66 interrupt light emitted from the light-emitting element 160*a* vary according to the mounting velocity. Still, the first waveform is always longer than the second waveform, regardless of the mounting velocity.

On the other hand, in the case releasing the locked state of the cover member 170 to remove the ink cartridge 4 from its mounted state, the large urging forces of the springs increase the velocity of the ink cartridge 4 immediately after the locked state is released, as described above. Subsequently, the velocity of the ink cartridge 4 decreases rapidly as the urging force lessens. However, since the front light-shielding part 65 is longer than the rear light-shielding part 66 in the front-to-rear direction, the shorter rear light-shielding part 66 interrupts emitted light during the interval that the velocity of the ink cartridge 4 is high immediately after the locked state with the cover member 170 is released, and the longer front light-shielding part 65 interrupts emitted light when the velocity has decreased. As shown in FIGS. 22 and 23, the first waveform is always shorter than the second waveform, though the lengths of the two waveforms produced when the light-shielding parts 65 and 66 interrupt light emitted from the photosensor 160 vary according to the removing velocity.

Based on these output waveforms, the control unit 3 determines that the ink cartridge 4 has been mounted when the first waveform is longer than the second waveform and conversely determines that the ink cartridge 4 has been removed when the first waveform is shorter than the second waveform. Accordingly, the control unit 3 can accurately differentiate between a mounting operation and a removal operation performed on the ink cartridge 4.

Next, variations of the above embodiment will be described, wherein like parts and components are designated with the same reference numerals to avoid duplicating description.

<First Variation>

The two light-shielding parts (first light-shielding parts) that interrupt light emitted from the photosensor during the mounting or removal operation of the ink cartridge 4 need not be provided on the detection part 50 of the cartridge body 20. The light-shielding parts will achieve the same operations and effects, provided that the positional relationship with the cartridge body 20 does not change.

Figure 24:
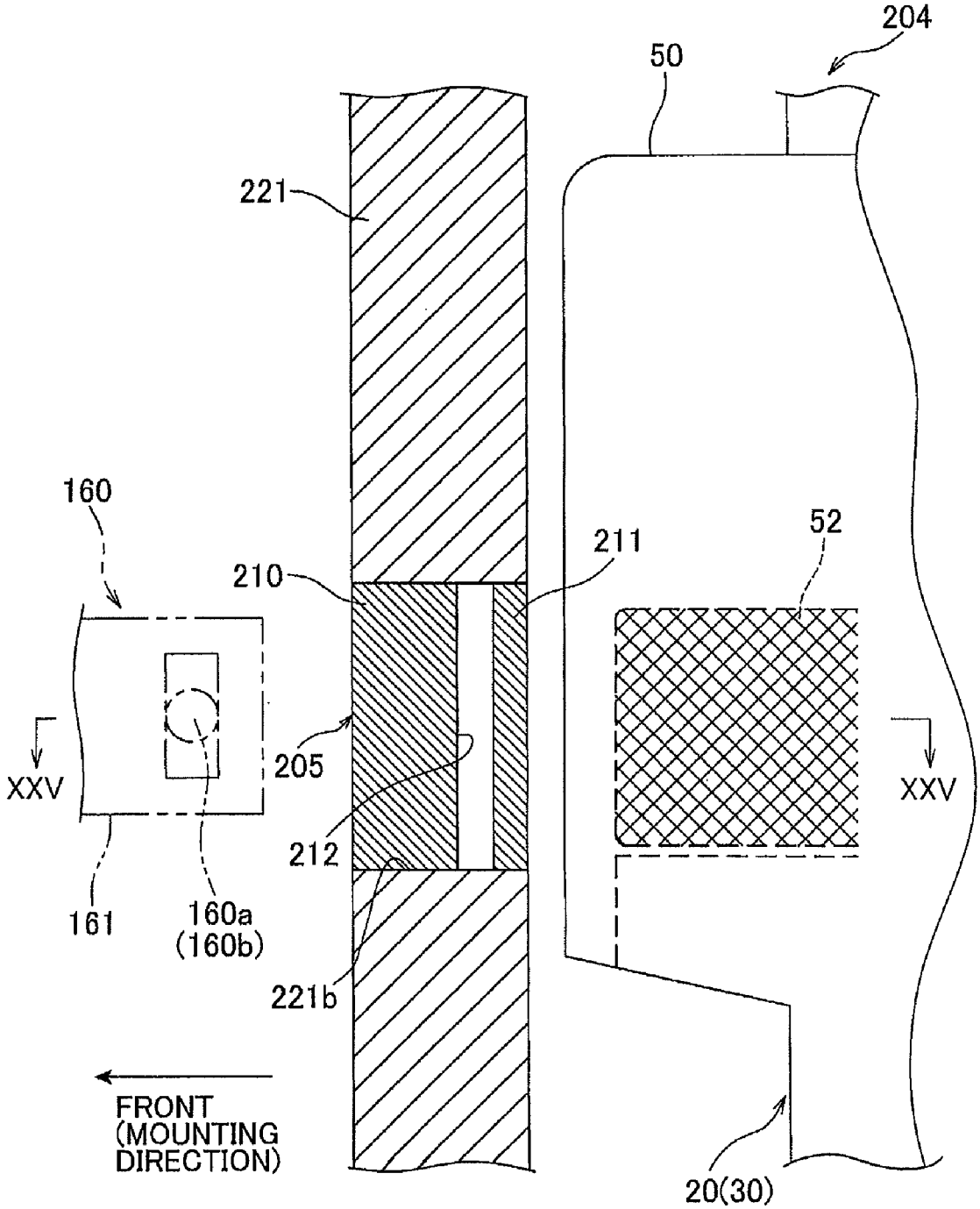
FIG. 24 is an enlarged view of a front end of an ink cartridge according to a first variation.
Figure 25:
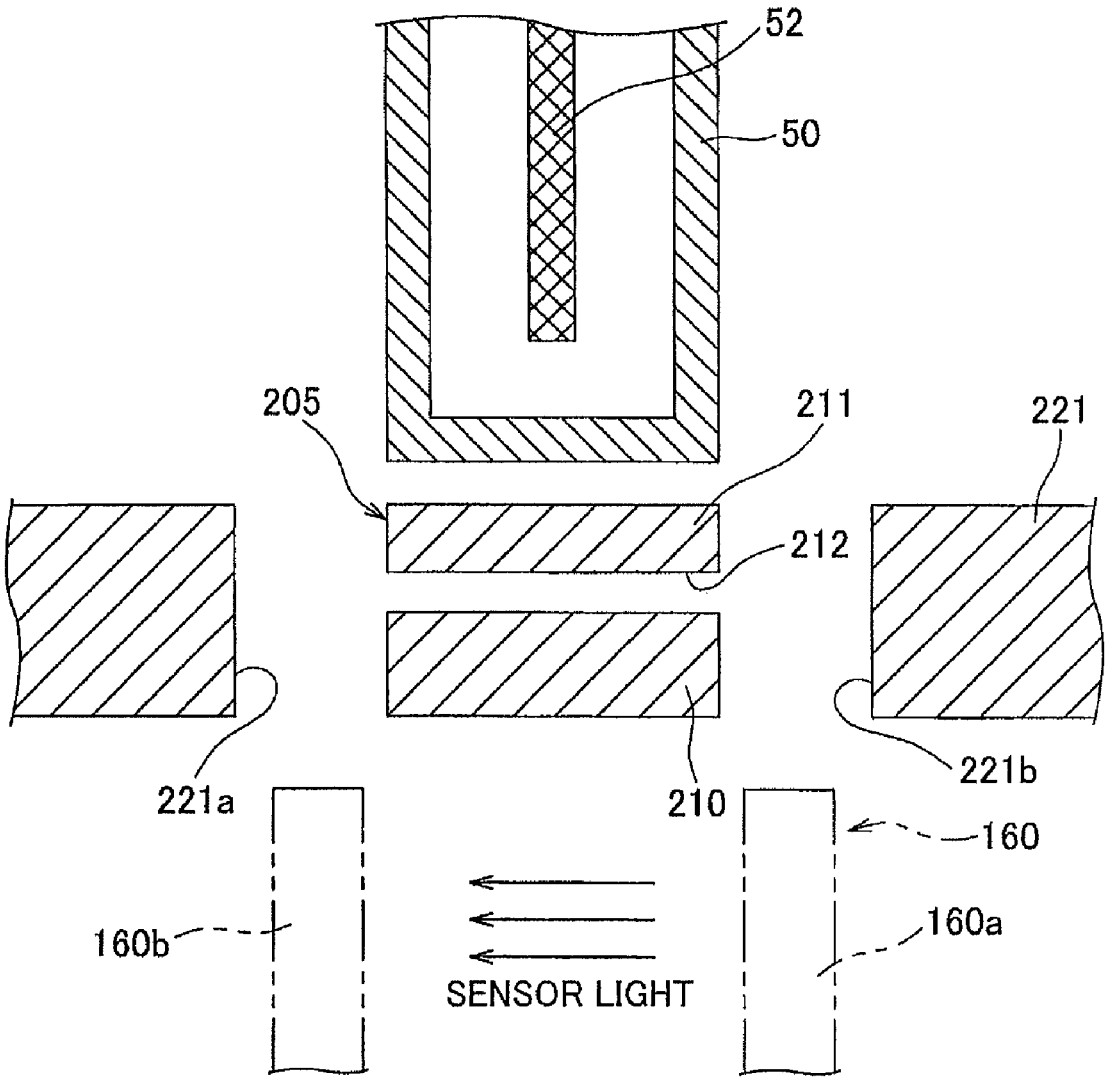
FIG. 25 is a cross-sectional view taken along XXV-XXV plane shown in FIG. 24.

For example, two light-shielding parts 210 and 211 may be disposed on an external case 221 covering substantially the entire cartridge body 20 (ink-accommodating member 30), as shown in FIGS. 24 and 25 (first variation). In the first variation, the light-shielding member 60 of the embodiment (see FIGS. 4-6) is not provided on the detection part 50 of the cartridge body 20. Instead, two through-holes 221*a* and 221*b* penetrate the external case 221 in areas on either side of the area covering the front surface of the detection part 50. When an ink cartridge 204 is mounted, the light-emitting element 160*a* and the light-receiving element 160*b* of the photosensor 160 are respectively inserted through the through-holes 221*a* and 221*b*.

Both surfaces of the external case 221 in at least region divided by the through-holes 221*a* and 221*b* (the surfaces facing the through-holes 221*a* and 221*b*) have a light-shielding capacity. A slit 212 is formed in a light-shielding portion 205 including the light-shielding parts 210 and 211 at a position slightly rearward of the center with respect to the front-to-rear direction. The slit 212 penetrate the light-shielding portion 205 in the width direction of the external case 221 (left-to-right direction in FIG. 25) for linking the through-holes 221*a* and 221*b*. In other words, the light-shielding portion 205 of the external case 221 positioned in front of the detection part 50 is divided into front and rear parts by the slit 212, forming two light-shielding parts having different front-to-rear dimensions (the longer front light-shielding part 210 and the shorter rear light-shielding part 211).

The dimensions of the light-shielding parts 210 and 211 in the front-to-rear direction (mounting direction) are different in the first variation. Thus, the lengths of the two waveforms outputted from the photosensor 160 when the light-shielding parts 210 and 211 interrupt light emitted from the light-emitting element 160*a* differ between mounting and removal of the ink cartridge 204. Accordingly, as described in the embodiment, the control unit 3 recognizes whether the ink cartridge 204 has been mounted or removed.

<Second Variation>

In the embodiment described above, the light-shielding plate 52 (second light-shielding part) for detecting residual ink in the ink cartridge by interrupting light emitted from the photosensor when the ink cartridge is mounted and the float part 53 having a larger volume than the light-shielding plate 52 are disposed respectively on opposite ends of the arm part 54, which is supported so as to be able to pivot freely. Hence, the light-shielding plate 52 and the float part 53 are configured to move opposite to each other with respect to a pivoting center (see FIG. 4). However, the structure to which the invention is applied is not limited to this structure.

Figure 26:
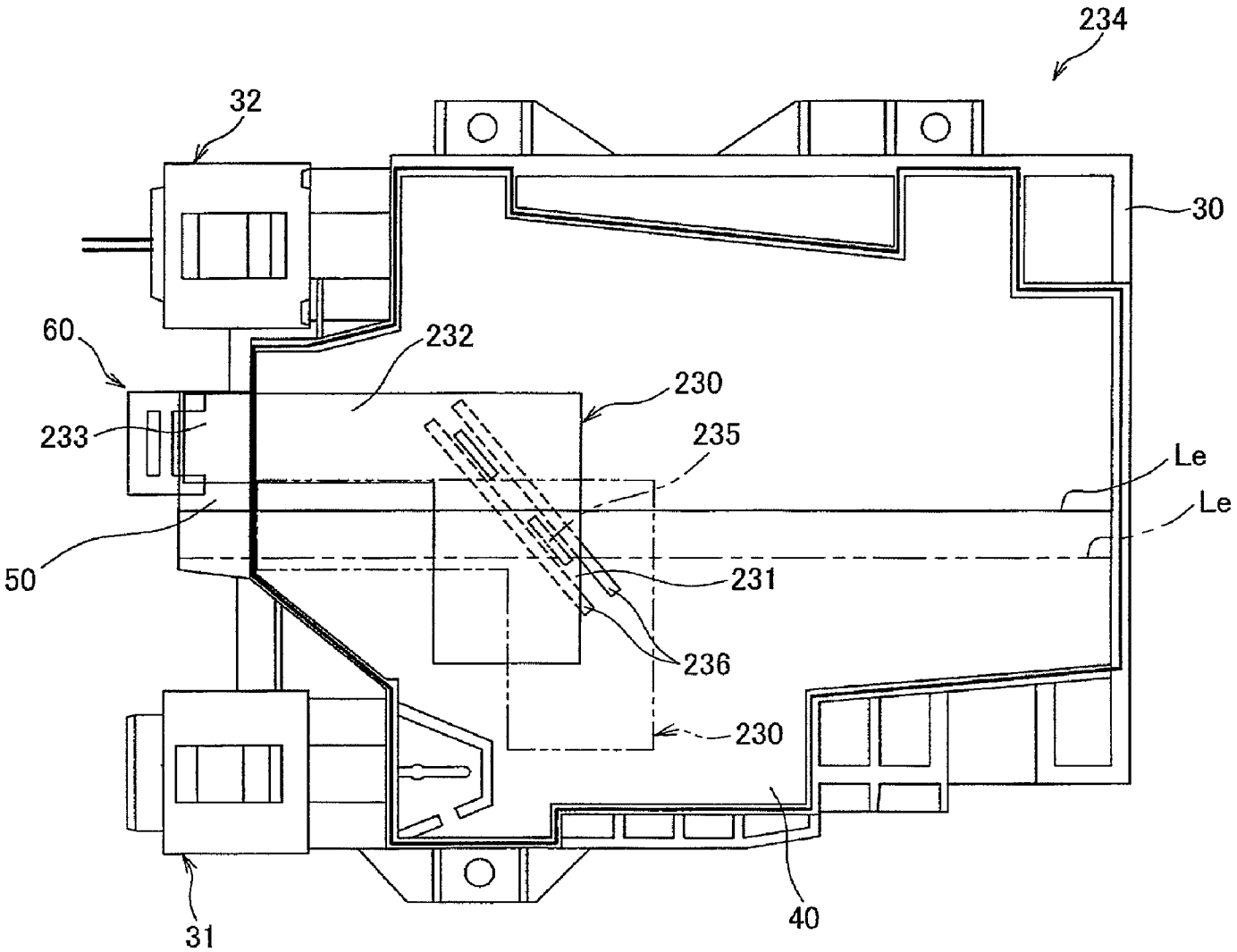
FIG. 26 is a side view of a cartridge body according to second variation.

For example, the light-shielding plate and the float part may be configured to move in parallel when the float part moves in response to changes in the ink level (second variation). As shown in FIG. 26, a float member 230 is disposed in the ink chamber 40 formed in the ink-accommodating member 30 of an ink cartridge 234. The float member 230 is formed of a material having a smaller specific gravity than the ink. The float member 230 includes a float part 231 that floats on the ink surface, an arm part 232 extending horizontally forward from the float part 231, and a light-shielding plate 233 disposed on the front end of the arm part 232 and having a light-shielding property. Further, two guides 236 are provided on the inner surface of the ink-accommodating member 30 extending along a slope from an upper forward position to a lower rearward position. A protruding part 235 provided on the float member 230 is engaged between the guides 236. Hence, the float part 231 moves along the two guides 236 as the ink level drops.

The light-shielding plate 233 is accommodated in the detection part 50 provided on the front end of the ink-accommodating member 30. When there is sufficient residual ink so that an ink level Le is at a higher position indicated by a solid line in the drawing, the light-shielding plate 233 is engaged with the upper inner surface of the detection part 50, and is positioned within the upper half of the detection part 50. When the ink cartridge 234 is in the mounted state, the light-emitting element and the light-receiving element of the photosensor are disposed on either side of the upper half of the detection part 50. Hence, when there is sufficient residual ink, the light-shielding plate 233 blocks light emitted from the light-emitting element, turning the photosensor on. However, when the ink level Le drops to a point indicated by the broken line, the float part 231 moves diagonally downward and rearward along the guides 236, and the light-shielding plate 233 moves integrally with and parallel to the float part 231. When the light-shielding plate 233 is extracted from the upper half of the detection part 50, the light-shielding plate 233 no longer blocks light emitted from the light-emitting element. Accordingly, the photosensor off is turned off.

By mounting, for example, the ink cartridge 234 having this construction mounts the same light-shielding member 60 described above in the embodiment in the upper half of the detection part 50, the control unit 3 can distinguish between a mounting and removal operation performed with the ink cartridge 234 and can detect residual ink in the mounted ink cartridge 234.

The two guides 236 may also be configured to extend vertically so that the float part 231 and the light-shielding plate 233 move downward when the level of ink drops.

<Third Variation>

A photosensor for detecting mounting and removal of an ink cartridge need not be configured to detect the residual ink as well. The residual ink may be detected by detecting means separate from the photosensor used to detect the two light-shielding parts of the light-shielding member (third variation). In this case, the photosensor that detects the two light-shielding parts is used solely for detecting mounting and removal of the ink cartridge.

Figure 27:
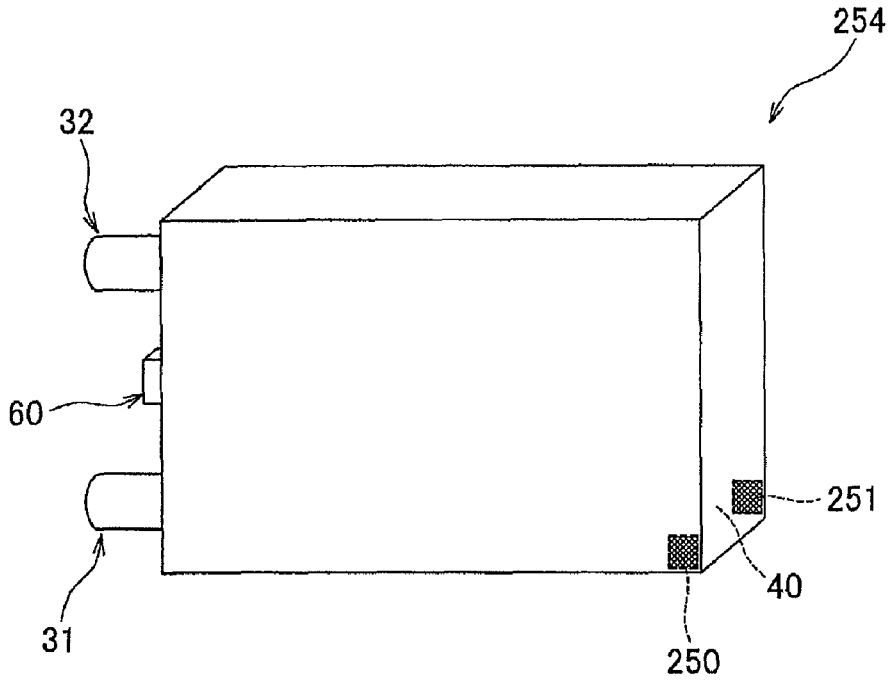
FIG. 27 is a perspective view diagrammatically illustrating an ink cartridge according to a third variation.
Figure 28A:
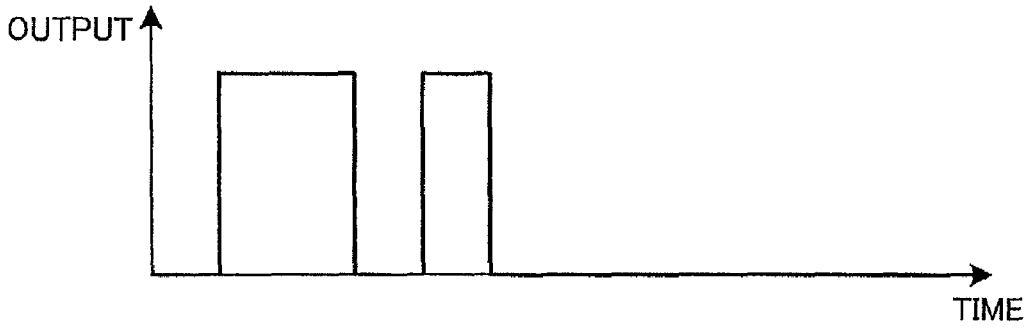
FIG. 28(*a*) shows waveforms from the photosensor when the sensor is normal state according to the third variation.
Figure 28B:
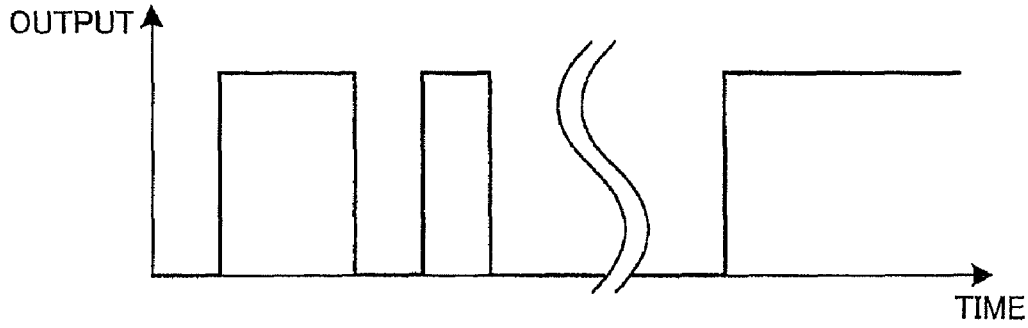

A structure designed solely for detecting residual ink may be implemented by a well-known construction, such as the following. As shown in FIG. 27, a pair of electrodes 250 and 251 for detecting residual ink may be affixed to the inner surface of the ink chamber 40 provided in an ink cartridge 254 near the bottom of the ink chamber 40. When the ink cartridge 254 having this construction is mounted in a cartridge-mounting unit, the electrodes 250 and 251 connect to contacts provided on the cartridge-mounting unit. The control unit of the inkjet printer detects a resistance value between the electrodes 250 and 251 and monitors changes in the detected value. Thus, the control unit of the inkjet printer can recognize changes of (the existence of) residual ink. The electrodes 250 and 251 are preferably disposed on the opposite side from the ink-outputting unit 31 (rear end) to prevent ink from becoming deposited on the contacts on the ink cartridge 254 side and the contacts on the cartridge-mounting unit side.

Residual ink may also be detected by counting (using a counter implemented in software) the number of ink ejections after a new ink cartridge is mounted in the printer. Alternatively, in addition to the photosensor used for detecting mounting and removal of the ink cartridge, another transmission-type photosensor may be provided for detecting movement of a light-shielding part (corresponding to the light-shielding plate 52 of the sensor arm 51 in the preferred embodiment) in response to changes in residual ink, making it possible to detect the presence of ink.

The structure of the third variation obtains the same effect of the embodiment in distinguishing between mounting and removal operations performed on the ink cartridge. The third variation obtains another effect particular to its construction that is not obtained with the structure of the embodiment. This effect will be described next.

In the embodiment described above, the state in which the light-shielding plate blocks light emitted from the light-emitting element (ON state) is sustained while sufficient ink remains in the mounted ink cartridge (see FIG. 11). If the photosensor were to malfunction at this time so that the light-emitting element no longer emits light, the light-receiving element will still not receive light and, thus, the photosensor output will not change and the control unit of the inkjet printer cannot detect the malfunction of the photosensor. Consequently, the control unit will recognize that the ink cartridge has ink and will continue to print even after all the ink has been consumed, thus printing without ejecting ink.

In the construction of the third variation, on the other hand, a member for blocking light emitted from the light-emitting element (corresponding to the light-shielding plate 52 in the embodiment) is not disposed at a position aligned with the two light-shielding parts in the front-to-rear direction, regardless of the amount of ink remaining in the ink cartridge. Accordingly, after the two light-shielding parts pass the photosensor, the light-receiving element continuously receives light from the light-emitting element (OFF state). Therefore, when the photosensor malfunctions so that the light-emitting element can no longer emit light, the light-receiving element will no longer receive light, turning the photosensor on. Consequently, the control unit can immediately detect a malfunction in the photosensor, since the output from the photosensor changes when the malfunction occurs, thereby detecting this malfunction at an early stage.

<Fourth Variation>

Due to the structures of the ink cartridge and the cartridge-mounting unit in the embodiment described above, the cover member is pushed against the urging forces of springs to lock the ink cartridge being mounted. Thus, when the lock produced by the cover member is released to remove the ink cartridge, the cartridge pops out, producing an abrupt change in velocity. To avoid incorrect determinations caused by these changes in velocity, in particular the front light-shielding part 65 on the front side (downstream side in the mounting direction) is made longer in the front-to-rear direction than the rear light-shielding part 66 on the rear side (upstream side in the mounting direction). However, there are some cases in which a rapid change in velocity may not be produced through the structures of the ink cartridge and the cartridge-mounting unit when the ink cartridge is removed, such as when the user directly grips and removes the ink cartridge. Since there is no particular need to form the front light-shielding part longer than the rear light-shielding part in such a case, the front light-shielding part may be formed shorter than the rear light-shielding part, provided that the lengths of the front and rear light-shielding parts differ.

Further, the invention is not limited to two light-shielding parts (first light-shielding parts), but may be provided with three or more light-shielding parts having differing lengths in the front-to-rear direction.

What is claimed is:

1. An ink cartridge mountable on a cartridge mounting section of an inkjet recording system through insertion of the ink cartridge in a prescribed mounting direction, the inkjet recording system including an optical detecting unit, the ink cartridge comprising:

a cartridge main body that has an ink accommodating chamber accommodating ink therein;

an ink-outputting section that outputs the ink in the ink accommodating chamber; and at least two first light-shielding parts that are juxtaposed in the prescribed mounting direction at a prescribed interval and that are incapable of moving relative to the cartridge main body, the at least two first light-shielding parts being used in conjunction with the optical detecting unit for detecting mounting and dismounting of the ink cartridge, wherein lengths in the prescribed mounting direction of the at least two first light-shielding parts are different from one another.

2. The ink cartridge according to claim 1, further comprising a second light-shielding part that is used in conjunction with the optical detecting unit for detecting an amount of ink accommodated in the ink accommodating chamber, wherein the second light-shielding part is capable of moving toward a position adjacent to the at least two first light-shielding parts in the prescribed mounting direction.

3. The ink cartridge according to claim 2, further comprising a float part that is connected to the second light-shielding part, that has a specific gravity lower than a specific gravity of the ink in the ink accommodating chamber, and that moves to follow the fluctuations of an ink level accommodated in the ink accommodating chamber, wherein the motion of the float part by the fluctuations of the ink level prompts the second light-shielding part to move to the position adjacent to the at least two first light-shielding parts.

4. The ink cartridge according to claim 3, further comprising a pivoting arm that is pivotably supported in the cartridge main body, wherein the second light-shielding part is attached to one end of the pivoting arm and the float part is attached to another end of the pivoting arm, wherein the motion of the float part by the fluctuations of the ink level prompts the pivoting arm to pivot and the second light-shielding part to move to the position adjacent to the at least two first light-shielding parts.

5. The ink cartridge according to claim 3, wherein when the float part moves following the fluctuation of the ink level in the ink accommodating chamber, the second light-shielding part moves in a direction parallel to a direction in which the float part moves.

6. The ink cartridge according to claim 1, wherein the ink-outputting section has an ink-outputting channel fluidly communicated with the ink accommodating chamber, and an opening/closing mechanism that opens and closes the ink-outputting channel, wherein the opening/closing mechanism includes:

a valve that is movable between a close position and an open position, the valve closing the ink-outputting channel at the close position and opening the ink-outputting channel at the open position; and an urging member that urges the valve toward the close position.

7. The ink cartridge according to claim 6, wherein the cartridge mounting section includes an ink extraction tube that pushes the valve toward the open position and fluidly communicates with the ink-outputting channel when the ink cartridge is mounted on the cartridge mounting section, wherein the ink-outputting section includes a joint part to which the ink extraction tube is inserted, wherein the at least two first-light shielding parts include a frontmost light-shielding part and a rearmost light-shielding part, the frontmost light-shielding part being closest to the cartridge mounting section and the rearmost light-shielding part being farthest to the cartridge mounting section when the ink cartridge is placed for insertion in the cartridge mounting section, wherein a length in the prescribed mounting direction from a front end of the frontmost light-shielding part to a rear end of the rearmost light-shielding part is less than or equal to a connection stroke from a start point for insertion of the ink extraction tube into the joint part to a point where the ink extraction tube moves the valve to the open position.

8. The ink cartridge according to claim 7, wherein the cartridge mounting section includes a locking mechanism that holds the mounted ink cartridge in a locked state, wherein the joint part separates from the ink extraction tube by an urging force of the urging member of the opening/closing mechanism when the locking mechanism unlocks the ink cartridge, wherein a length of the frontmost light-shielding part in the prescribed mounting direction is longer than a length of the rearmost light-shielding part in the prescribed mounting direction.

9. The ink cartridge according to claim 7, wherein the urging member comprises a spring.

10. An ink cartridge mountable on a cartridge mounting section of an inkjet recording system through insertion of the ink cartridge in a prescribed mounting direction, the inkjet recording system including an optical detecting unit, the ink cartridge comprising:

a cartridge main body that has an ink accommodating chamber accommodating ink therein;

an ink-outputting section that outputs the ink in the ink accommodating chamber; and at least two first light-shielding parts that are juxtaposed in an outputting direction to which the ink-outputting unit outputs the ink at a prescribed interval and that are incapable of moving relative to the cartridge main body, the at least two first light-shielding parts being used in conjunction with the optical detecting unit for detecting mounting and dismounting of the ink cartridge, wherein lengths in the outputting direction of the at least two first light-shielding parts are different from one another.

11. An inkjet recording system comprising:

an inkjet recording device that has an inkjet head ejecting ink; and an ink cartridge that is mounted in a cartridge mounting section of the inkjet recording device through insertion of the ink cartridge in a prescribed mounting direction, wherein the inkjet recording device includes an optical detecting unit that has a light emitting part and a light receiving part receiving light from the light emitting part, wherein the ink cartridge includes:

a cartridge main body that has an ink accommodating chamber accommodating ink therein;

an ink-outputting section that outputs the ink in the ink accommodating chamber; and at least two first light-shielding parts that are juxtaposed in the prescribed mounting direction at a prescribed interval and that are incapable of moving relative to the cartridge main body, the at least two first light-shielding parts being used in conjunction with the optical detecting unit for detecting mounting and dismounting of the ink cartridge, wherein lengths in the prescribed mounting direction of the at least two first light-shielding parts are different from one another.

* * * * *